US012722840B2

(12) United States Patent
Marks

(10) Patent No.: US 12,722,840 B2
(45) Date of Patent: Sep. 1, 2026

(54) FOLDABLE CONTAINER

(71) Applicant: Ography Pty Ltd, Hepburn Springs (AU)

(72) Inventor: Prudence Marks, Hepburn Springs (AU)

(73) Assignee: Ography Pty Ltd, Hepburn Springs (AU)

( * ) Notice: Subject to any disclaimer, the term of this patent is extended or adjusted under 35 U.S.C. 154(b) by 71 days.

(21) Appl. No.: 18/718,972

(22) PCT Filed: Dec. 16, 2022

(86) PCT No.: PCT/AU2022/051527
§ 371 (c)(1),
(2) Date: Jun. 12, 2024

(87) PCT Pub. No.: WO2023/108229
PCT Pub. Date: Jun. 22, 2023

(65) Prior Publication Data

US 2025/0128852 A1 Apr. 24, 2025

(30) Foreign Application Priority Data

Dec. 17, 2021 (AU) ..... 2021904109

(51) Int. Cl.
*B65D 5/22* (2006.01)
*B65D 5/355* (2006.01)

(52) U.S. Cl.
CPC ..... *B65D 5/22* (2013.01); *B65D 5/0005* (2013.01)

(58) Field of Classification Search
CPC ..... B65D 5/22; B65D 5/0005; B65D 5/64; B65D 5/643; B65D 5/563;
(Continued)

(56) References Cited

U.S. PATENT DOCUMENTS 2,663,487 A 12/1953 Paige
2,793,802 A * 5/1957 Scaturro ..... B65D 5/22 229/125
(Continued)

FOREIGN PATENT DOCUMENTS

GB 719411 A * 12/1954 ..... B65D 5/0005
JP S5943213 Y2 12/1984
(Continued)

OTHER PUBLICATIONS

International Search Report for Application No. PCT/AU2022/051527 dated Jan. 27, 2023 (3 pages).
(Continued)

*Primary Examiner* — Christopher R Demeree
(74) *Attorney, Agent, or Firm* — Michael Best & Friedrich LLP

(57) ABSTRACT

A foldable container, a blank for forming the foldable container, and a method of forming the foldable container from the blank. The container comprising a base and four upstanding walls that extend therefrom and together define an internal space for storing contents therein, the upstanding walls including a pair of opposing end walls and a pair of opposing side walls, at least one the end walls configured to moveably interlock with the pair of side walls to hold the container in an assembled form, wherein the container is transitionable between a contracted configuration and an expanded configuration.

19 Claims, 19 Drawing Sheets

(58) Field of Classification Search
CPC ..... B65D 2571/0066; B65D 5/248; B65D 2571/00796; B65D 5/242; B65D 5/302; B65D 5/60; B31B 2100/0024
USPC ..... 229/100, 123, 101, 186, 125, 130, 149, 229/178, 199; 206/45.29, 45.3; 493/110
See application file for complete search history.

(56) References Cited

U.S. PATENT DOCUMENTS

| | | | | |
|---|---|---|---|---|
| 2,878,983 | A | 3/1959 | Dulaney | |
| 3,370,775 | A * | 2/1968 | Link | B65D 83/00 206/815 |
| 4,295,599 | A | 10/1981 | Locatelli et al. | |
| 11,535,420 | B2 * | 12/2022 | Prior | B65D 5/563 |
| 12,344,445 | B2 * | 7/2025 | Ackroyd | B65D 81/3453 |
| 2012/0228371 | A1 | 9/2012 | Jang | |
| 2017/0144792 | A1 * | 5/2017 | Block | B65D 25/30 |

FOREIGN PATENT DOCUMENTS

| | | | |
|---|---|---|---|
| JP | 2002308277 | A | 10/2002 |
| KR | 20160123043 | B1 | 2/2017 |

OTHER PUBLICATIONS

International Preliminary Report on Patentability for Application No. PCT/AU2022/051527 dated Mar. 27, 2024 (5 pages).

* cited by examiner

FIGURE 1
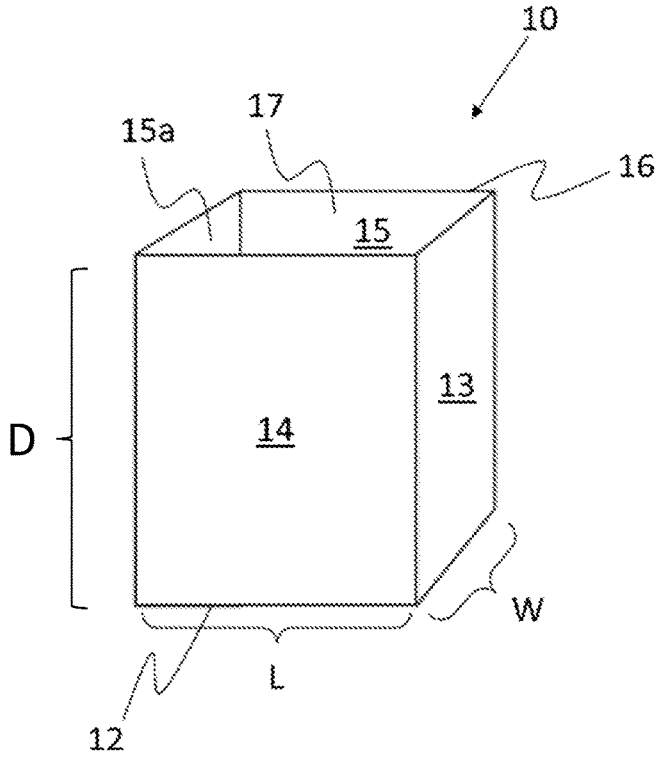
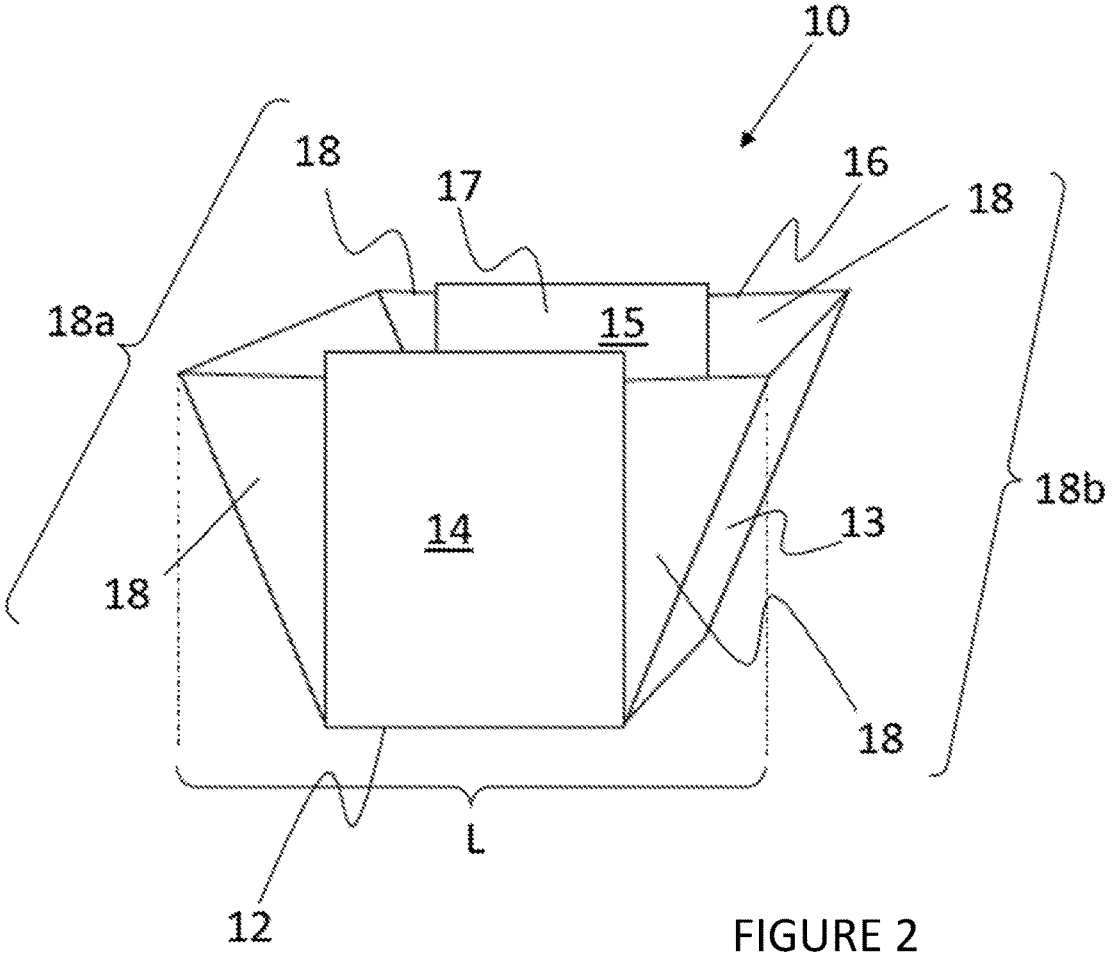
FIGURE 2

FIGURE 3
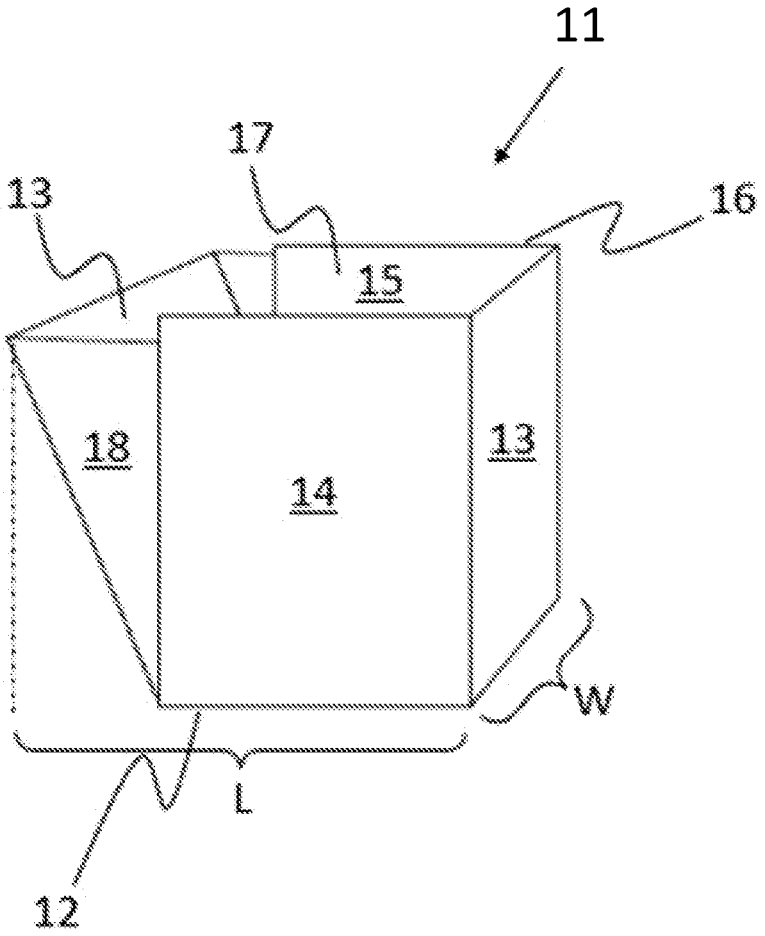
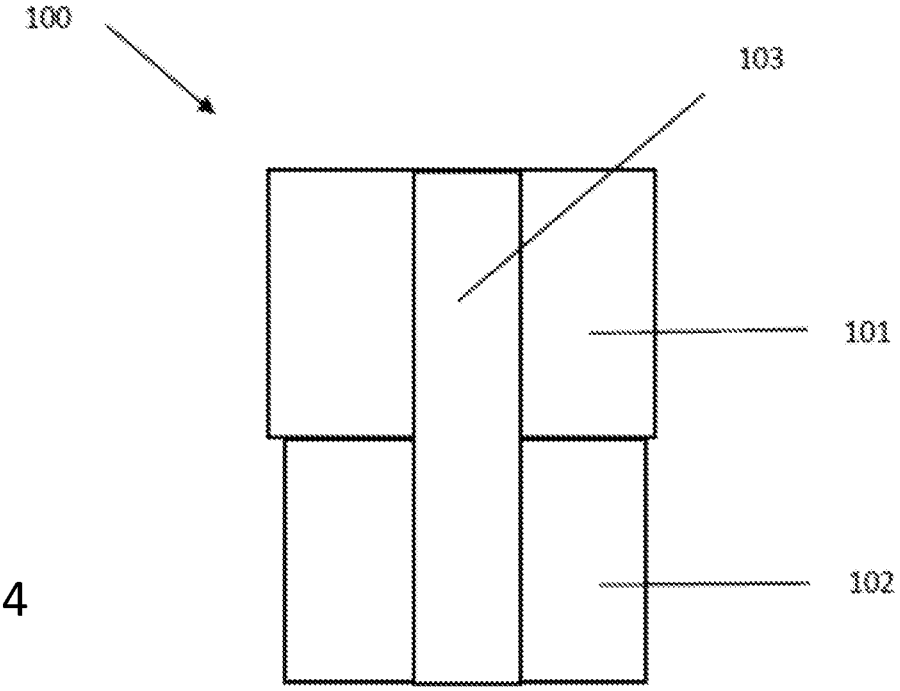
FIGURE 4

FOLDABLE CONTAINER

TECHNICAL FIELD

The present invention relates to a foldable container. More particularly, the invention relates to a foldable container that is transitionable between a contracted configuration and an extended configuration, a blank for forming said container and a method for assembling the foldable container from said blank.

BACKGROUND

Containers are used for many purposes. For example, containers are used as packaging for a range of products. Such packaging containers are typically square or rectangular to maximise stackability and compactness for bulk transport and storage. Conversely, containers are also used for holding and storing contents such as foodstuffs in the home. Containers can also, on occasion, be used as serving dishes or vessels.

Broadly speaking, containers are typically formed in one of two ways.

Moulded containers are shaped via the moulding and setting of flowable materials in a dye. Moulded containers provide rigid, non-deformable receptacles that are well suited to protecting the contents therein. Because of their rigid nature, however, the bulk transport and storage of empty moulded containers poses difficulties, a problem that is only partly alleviated by the nesting together of like products. Likewise, the moulded shape and/or size of such containers can limit their usefulness to specific tasks, hindering their ability to be multi-purpose. Storage containers are typically made in this manner.

Foldable containers, on the other hand, are shaped from blanks of a foldable material such as cardboard, and then assembled into a container by folding portions of the blank in a prescribed manner. The flat blanks can be shipped and stored easily, prior to being assembled and forming the container. Foldable containers are typically single use, because they are held together in the assembled state with the aid of an adhesive such as glue or tape. That is, whilst it is possible to flatten a foldable container after its contents have been emptied, the flattening process may damage the container hindering reassembly and re-use.

It would be advantageous to provide an improved foldable container. It would be beneficial if such a container could provide more than one assembled form/shape. It would be desirable if such a container could be flattened and reassembled to allow for re-use.

The present invention was conceived with these shortcomings in mind.

SUMMARY

In a first aspect, the invention provides a container formed from a blank of foldable material, comprising a base and four upstanding walls extending therefrom and together defining an open-ended container with an internal space for storing contents therein, the four upstanding walls including a pair of opposing end walls and a pair of opposing side walls, at least one of the end walls configured to moveably interlock with the pair of side walls to hold the container in an assembled form, wherein the container is transitionable between a contracted configuration and an expanded configuration.

In some embodiments, each of the end walls are configured to moveably interlock with the pair of side walls to hold the container in an assembled form, wherein the container is transitionable between a contracted configuration and an expanded configuration An advantage of the invention lies in the fact that the container has two distinct configurations: a contracted and an expanded configuration. The first, contracted configuration is suited for display and transport due to its reduced footprint. The second, expanded configuration provides easier access to the contents therein by way of the increased opening. In some embodiments both ends of the container may be configured to expand providing an expanded configuration. In some embodiments only a first end of the container is configured to expand to provide the expanded configuration.

In an embodiment, the pair of first walls comprise a pair of end walls and the pair of second walls comprises a pair of side walls. While the following description will focus on this embodiment, it is to be understood that the invention is not limited to this embodiment and may extend to the arrangement where the first walls are end walls and the second walls are side walls.

In some embodiments, the container may be held in an assembled form by the interlocking of the end walls and side walls without the need for adhesive.

Each of the end walls may include a pair of opposing wing walls that extend from respective lateral sides thereof. Each wing wall may extend substantially perpendicular to the end wall. The wing walls may moveably interlock with the side walls of the container. In the contracted configuration the wing walls may be hidden behind the side walls and in the expanded configuration the wing walls effectively provide an extension of the side walls resulting in the expansion of the container and the internal space therein.

In a second aspect, the invention provides a packaging unit comprising an upper component and a lower component, the upper component serving as a removeable cover for the lower component, wherein at least one of the upper and lower components is a container as described herein. The container unit may further comprise a band that extends around the upper component and the lower component to secure the upper and lower components together An advantage of the invention lies in the fact at least one of the upper and lower portions can be transitioned between a contracted, first configuration and an expanded, second configuration. This makes the packaging unit well suited for use as a "share-pack" for consuming foodstuffs. Furthermore, the band provides a simple yet effective mechanism for securing the upper portion to the lower portion, to thereby retain the contents therein.

In some embodiments, the container may further comprise a lockable closer is removably securable to the container. The lockable closer can be selectively removed from the container to facilitate access to the internal space and the stored contents therein. Alternatively, the closer can be locked in position, sealing the opening to the container and restricting access to the internal space. The lockable closer is engaged to the container and locked thereabouts without the need for adhesive.

The lockable closer may comprise: a lid; a band; and a detent. The lid may comprise a plurality of sub-panels at least one of the sub-panels being dimensioned to seal the opening of the container in the contracted configuration and at least one of the sub-panels being configured to extend into the internal space of the container when affixed to the container. The detent may comprise a pair of cooperating features than releasably engage one another. The detent may comprise an aperture for receiving and retaining a cooperating tab therein.

In a third aspect, the invention provides a blank of foldable material for forming an open ended container when assembled, the container including a base and four upstanding walls extending therefrom that together define an internal space for storing contents therein, the blank comprising: a central panel that provides the base of the container when assembled; a pair of end panels separated from the central panel by respective first fold lines, said pair of end panels providing end walls of the container when assembled; and a pair of side panels separated from the central panel by respective second fold lines, said pair of side panels providing side walls of the container when assembled; wherein at least one of the end panels and the side panels are configured to movably interlock with one another when the container is assembled, to thereby enable the assembled container to transition between a first contracted configuration and a second expanded configuration.

An advantage of the invention lies in the fact that the interlocking between the end panels and side panels of the blanks may be sufficient to retain the container in its assembled form without the need for adhesive. Accordingly, adhesive may not be essential for assembly. This allows the assembled container to be disassembled and flattened without damage caused by adhesive (eg. tearing or ripping) to return to its unassembled, blank form for easy storage and subsequent re-use.

Each of the end panels may include a pair of lateral flaps separated from a central part thereof by respective third fold lines. The third fold lines may extend substantially perpendicular to the first fold lines. The central part of the end panel may correspond to the end wall of the container when assembled. The lateral flaps may correspond to the wing walls of the container when assembled. The wing walls of the container may extend substantially perpendicular to the end walls when assembled, the wing walls being hidden behind the side walls when the container is in the first configuration and providing an extension of the side walls when the container is in the second configuration. Each of the lateral flaps may comprise a pair of flap segments separated from each other by respective fourth fold lines, the fourth fold lines extending from the central panel at angle between the third fold line and an edge outer edge of the respective flap In some embodiments, each of the side panels may include a pair of lateral tabs separated from a central part thereof by respective fifth fold lines. The fifth fold lines may extend perpendicular to the second fold lines. The tabs may be held between the flap segments of the respective lateral flaps when the container is assembled.

In some embodiments, the blank may further comprise a fold-over panel separated from a first of the side panels by a sixth fold line that provides an inner lining of the container when assembled. The blank may further comprise a second fold-over panel separated from a second of the side panels. When assembled, the fold-over panel or panels may extend inwardly over the lateral flaps of the end panels such that the lateral flaps are held captive between the fold-over panel and the respective side panels to bias the lateral flaps against the respective side panels.

In a fourth aspect, the invention provides a method of assembling a container using a blank as described herein, comprising the steps of: folding the end panels inwardly relative to the base about the first fold lines; folding the side panels inwardly relative to the base about the second fold lines; and interlocking at least one of the end panels with the side panels to thereby define the upstanding walls of the container and the internal space therebetween.

An advantage of the invention lies in the fact that the container is assembled via a series of simple folding steps alone. Adhesives, tapes, staples, studs, pins, clips and the like are not required.

The method may further comprise the step of folding the lateral flaps inwardly relative to the end panel from which the flaps extend about the third fold lines to thereby define the wing walls of the container.

In some embodiments, the method may further comprise the steps of: folding each of the lateral flaps outwardly about the fourth fold line forming respective pairs of flap segments arranged back-to-back such that each wing wall is thus formed from a pair of flap segments; folding the tabs inwardly relative to the side panel from which the tabs extend about the fifth fold lines; and capturing each tab between a respective neighbouring pair of flap segments.

The method may further comprise the step of: folding the at least one fold-over panel relative to the side panel to which the fold-over panel is joined about the sixth fold line such that the flaps are held between the fold-over panel and the respective side panel.

BRIEF DESCRIPTION OF THE DRAWINGS

Embodiments of the invention are illustrated by way of example, and not by way of limitation, with reference to the accompanying drawings, of which:

FIG. 1 is a perspective view of a foldable container according to one embodiment of the invention; illustrating the container in a first, contracted, configuration;

FIG. 2 is a perspective view of the foldable container of FIG. 1, illustrating the container in a second, expanded, configuration;

FIG. 3 is a perspective view of another embodiment of a foldable container, illustrating the container in an expanded, configuration;

FIG. 4 is front view of a packaging unit according to one embodiment of the invention; the packaging unit comprising an upper portion, a lower portion and a closer configured as a band for sliding around an external perimeter of the packaging unit;

Figure 5A:
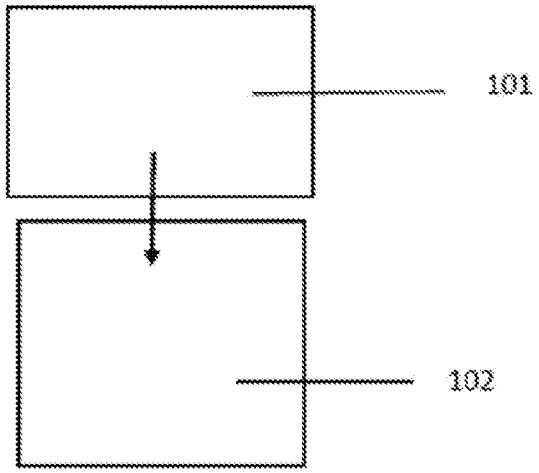
FIGS. 5A to 5B are front views of the packaging unit of FIG. 4, illustrating sequential stages of forming the packaging unit from components thereof.

Embodiments will now be described more fully hereinafter with reference to the accompanying drawings, in which various embodiments, although not the only possible embodiments, of the invention are shown.

DETAILED DESCRIPTION

The invention as illustrated in the FIGS. 1-2 broadly relates to a container 10. Specifically, the container 10 is formed from a blank 200,300 of foldable material, such as cardboard. The container 10 comprises a base 12, from which a pair of end walls 13 and a pair of side walls 14 extend. Together the base 12 and upstanding walls 13, 14 provide a space 15 for storing contents therein. Each of the end walls 13 are configured to moveably interlock with the adjacent side walls 14 to hold the container 10 in an assembled form. Notably, the container 10 is transitionable between a first, contracted configuration and a second, extended configuration, with the second configuration increasing a volume of the space 15 and thereby providing improved access to the contents stored therein.

FIGS. 1 and 2 show an embodiment of the container 10, in both the first, contracted configuration (FIG. 1) and the second, extended configuration (FIG. 2).

With reference to FIG. 1, the container 10 is an open-ended container, having an opening 16 defined by the two pairs of upstanding walls 13, 14 that extend from the base 12. The container 10 has a generally rectangular profile, with each of the pair of end walls 13 being parallel to one another and arranged perpendicular to each of the pair of side walls 14. The space 15 for storing contents provides an internal surface 15*a* which can be covered by a lining 17. Whilst not clearly shown in FIG. 1 or FIG. 2, the lining 17 covers the internal surface of both side walls 14 as well as the base 12. The lining 17 can have a non-stick coating applied to it, to reduce or avoid contents stored within from sticking to the container 10. Other types of coating are also envisaged, depending on the type of contents to be held within the container 10.

Moving now to FIG. 2, the opening 16 is enlarged when the container 10 is transitioned to the expanded configuration. This transition is enabled, at least in part, by way of wing walls 18 arranged in two pairs 18*a*, 18*b* on opposing sides of the container 10. Each pair of wing walls 18*a*, 18*b* is joined to one of the pair of end walls 13, and thus form part thereof. The pair of wing walls 18*a*, 18*b* project inwardly from the respective end wall 13 towards the space 15 and parallel to the pair of side walls 14. The wing walls 18 are not visible in FIG. 1, being completely hidden between the lining 17 and the side walls 14. The opposing wing walls 18 of each pair 18*a*, 18*b* can overlap with one another, behind the lining 17. In other embodiments (not shown), it is contemplated that only a portion of the wing walls 18 can be hidden in the contracted configuration, resulting in a generally elongate container 10.

In use, the container 10 is transitioned between the first contracted configuration and the second expanded configuration by pulling outwardly on each of the end walls 13. This results in an outward movement of the wing walls 18 from behind the lining 17, such that at least a portion of the wing wall 18 that was previously hidden behind the lining 17 is now visible. This movement of the wing walls 18 effectively provides an extension to the dimension of the side walls 14. This results in an increase in a length L of the opening 16 of the container 10, whilst the width W remains unchanged.

The movement of the wing walls 18 is a pivoting movement 18 about the base 12 along a fold line f1 (described later herein). What is meant by this pivoting movement is that in the second, expanded configuration, the end walls 13 are no longer perpendicular to the base 12. Rather, the end walls 13 are held at an outwardly inclined angle, providing the container 10 with a generally trapezoidal profile. With reference to the particular embodiment shown in the FIGS. 1-2, the second expanded configuration provides the container 10 with a canoe or "coolamon" shape.

Best shown in FIG. 2, the lining 17 also serves as a retention mechanism, by which the wing walls 18 are retained against the side walls 14. Specifically, the wing walls' 18 pass and translate between the respective side walls 14 and the lining 17, with the lining 17 having a bias that presses the wing walls 18 against the side walls 14. In this way, the wing walls 18 are held parallel to the side walls 14.

FIG. 3 shows a second embodiment of a container 11 in an expanded configuration. In this container 11, the pair of wing walls 18*a* extend from one end only of the respective side wall 14, while the opposing end wall 13 remains perpendicular to the base 12. Like container 10, the opening 16 of the container 11 in the expanded configuration is larger in length L than the opening 16 when the container 11 is in a first contracted configuration. In the expanded configuration, the extended wing walls 18*a* of the container 11 take on the form of a spout, that can be used for dispensing the contents from within the container 11. This configuration may be particularly useful for dispensing granular or liquid contents.

The container 11 is transitioned from the first, contracted configuration to the second expanded configuration by pulling on one end wall 13 only. The container 10 can be expanded to the second expanded configuration by pulling either end wall 13 of the container 10. That is, both end walls 13 can provide the extension. It is also contemplated, however, that only one end of the container 10 can expanded by the user.

Moving now to FIG. 4, the container 10,11 as shown in FIGS. 1 to 3 can be used as part of a packaging unit 100. The packaging unit 100 includes an upper component or lid 101 and a lower component or bottom 102. The upper component 101 serves as a removable cover for the lower component 102. Additionally, a band 103 can be wrapped around the upper and lower components 101, 102 to provide a retention means or closer by which the upper component 101 is held or secured over an opening of the lower component 102.

Figure 5B:
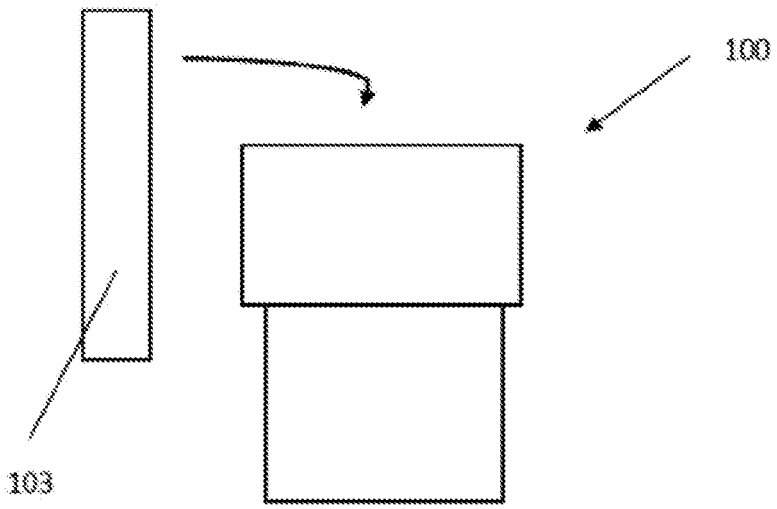

The way the packaging unit 100 is assembled together from components 101, 102 and 103 is shown in FIGS. 5A and 5B. As a first step, the upper component 101 is brought into engagement with the lower component 102, covering an opening thereof. It is understood, therefore, that the upper component 101 has slightly larger dimensions than those of the lower component 102, to be able to fit the upper 101 over the lower 102. Preferably, the fit between the upper and lower components 101,102 is a friction fit. Once the upper component 101 has been placed over the lower component 102 to form the packaging unit 100, the band 103 is then wrapped around the packaging unit 100. Preferably, the band 103 is provided as a closed loop, and is slid over ends of the packaging unit 100. In this way, the band 103 can easily be removed and reapplied to the packaging unit 100.

It is envisaged that at least one of the upper and lower components 101,102 of the packaging unit 100 is configured in accordance with the container 10,11 as described herein. For example, the container 10,11 can be used as the lower component 102 for a packaging unit 100 of foodstuffs. When the packaging unit 100 is on display in a supermarket or the like, the lower component 102 adopts the first contracted or retracted configuration. This provides a compact footprint that is well-suited for stacking on shelves and transportation. When a consumer purchases the packaging unit 100 and chooses to access for example, consume the stored contents, the consumer can open the packaging unit 100 by removing the band 103 and sliding the upper component 101 off the lower component 102. The consumer then expands the lower component 102 to either of the second expanded configurations for easy consumption or dispersion of the stored foodstuffs therein. In this way the lower component 102 serves as a serving bowl, doing away with the need for decanting the stored contents into a separate serving vessel.

Depending on the size of the packaging unit 100 and the type of contents therein, both the upper 101 and lower 102 components can be container 10,11. In this arrangement, both the upper 101 and lower 102 components can be transitioned to the second or third configurations and thereby provide a plurality of serving bowls with increased access to the stored contents. This may be particularly beneficial as a "share pack" for multiple consumers.

The container 10 is a foldable container and is formed from a flat blank 200. The following paragraphs will now describe the flat blank 200 from which the container 10 is assembled and describe a series of steps/stages by which the container 10 is formed from the flat blank. The flat blank 200 facilities ease of transport of the containers 10 and allows an end user to erect the containers from a stack of blanks one at a time as required.

Figure 6:
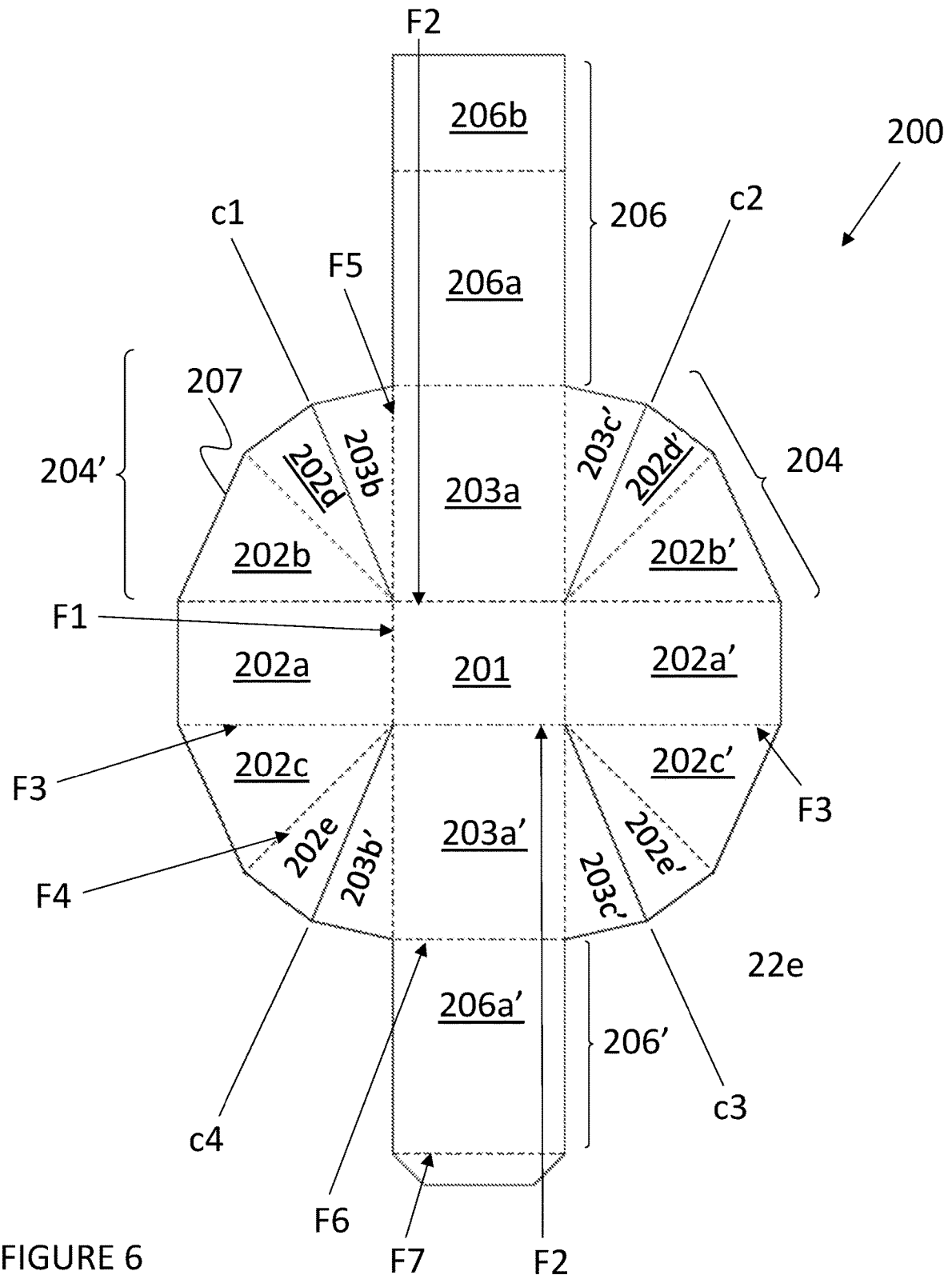
FIG. 6 is a plan view of a blank according to another embodiment of the invention, the blank being suitable for forming the foldable container of FIGS. 1 and 2.

FIG. 6 shows a first embodiment of the blank 200 for making the container 10 as described herein. The blank 200 is formed from a foldable material such as cardboard and includes a plurality of panels separated by fold or score lines. The primary panels of the blank 200 provide the blank with the shape of a dodecagon. The fold lines are illustrated in the FIGS. 6-10 in dashed outline. It is contemplated that the fold lines can be pre-scored to facilitate easier assembly. Also, it is contemplated that the fold lines are pre-marked.

The blank 200 includes a generally rectangular central panel 201, with a pair of end panels 202, 202' and a pair of side panels 203, 203' extending adjacently from perimeter edges thereof. In the illustrated embodiment, the first pair of end panels 202, 202' provide end walls 13, being separated from the central panel 201 via first fold lines f1 that extend along top and bottom edges of the central panel 201. The pair of side panels 203, 203' provide side walls 14, being separated from the central panel 201 via second fold lines f2 that extend along respective side edges of the central panel 201.

Each of the end panels 202, 202' comprise five sub-panels 202*a*-202*e* and 202*a*'-202*e*'. The sub-panels of end panel 202 include:

- a generally rectangular central sub-panel 202*a* that is separated from the base 201 by the first fold line f1;
- generally triangular sub-panels 202*b*, 202*c* that project from upper and lower edges of the sub-panel 202*a*, being separated therefrom by third fold line f3. The third fold lines f3 are parallel to the second fold lines f2 and form a continuation thereof; and
- generally triangular sub-panels 202*d*, 202*e* that project respectively from sub-panels 202*b* and 202*d*, being separated therefrom by a fourth fold line f4. The fourth fold lines f4 extend from the central panel 201, forming approximately a 45-degree angle with the third fold line f3. With specific reference to the illustrated embodiment, sub-panels 202*d* and 202*e* are generally smaller than sub-panels 202*b* and 202*c*.

The sub-panels of end panel 202' include:

- a generally rectangular central sub-panel 202*a*' that is separated from the base 201 by the first fold line f1;
- generally triangular sub-panels 202*b*', 202*c*' that project from upper and lower edges of the sub-panel 202*a*', being separated therefrom by third fold line f3. The third fold lines f3 are parallel to the second fold lines f2 and form a continuation thereof; and
- generally triangular sub-panels 202*d*', 202*e*' that project respectively from sub-panels 202*b*' and 202*d*', being separated therefrom by a fourth fold line f4. The fourth fold lines f4 extend from the central panel 201, forming approximately a 45-degree angle with the third fold line f3. With specific reference to the illustrated embodiment, sub-panels 202*d*' and 202*e*' are generally smaller than sub-panels 202*b*' and 202*c*'.

Together, sub-panels 202*b* and 202*d* form a first wing wall 18 and sub-panels 202*c* and 202*e* for a second wing wall 18; together forming the first pair of wing walls 18*a*. Together, sub-panels 202*d*' and 202*b*' form a first wing wall 18 and sub-panels 202*c*' and 202*e*' form a second wing wall 18; together forming the second pair of wing walls 18*b*. Each wing wall 18 of the pairs of wing walls 18*a*, 18*b* are substantially triangular in shape.

Each of the side panels 203, 203' comprises three sub-panels 203*a*-203*c*, 203*a*'-203*c*'. The sub-panels of side panel 203 include:

- a generally rectangular central sub-panel 203*a* that is separated from the base 201 by the second fold line f2; and
- generally triangular sub-panels 203*b*, 203*c* that project from opposing side edges of the sub-panel 203*a*, being separated therefrom by fifth fold lines f5. The fifth fold lines f5 are parallel to the first fold lines f1 and form a continuation thereof.

The sub-panels of side panel 203' include:

- a generally rectangular central sub-panel 203*a*' that is separated from the base 201 by the second fold line f2; and
- generally triangular sub-panels 203*b*', 203*c*' that project from opposing side edges of the sub-panel 203*a*', being separated therefrom by fifth fold lines f5. The fifth fold lines f5 are parallel to the first fold lines f1 and form a continuation thereof.

The blank 200 further includes at least one roll-over panel 206. The roll-over panel 206 is generally rectangular and projects from one of side panels 203*a*, 203*a*' being separated therefrom by a sixth fold line f6. The sixth fold lines f6 extend parallel to the second fold lines f2, being spaced therefrom by the respective side panel 203*a*.

In the illustrated embodiment of FIG. 6, there are two roll-over panels 206, with each side panel 203*a*, 203*a*' having a respective roll-over panel 206 projecting therefrom. In this embodiment, the roll-over panels can comprise two sub-panels 206*a*-206*b*, 206*a*'-206*b*'. *The sub*-panels of roll-over panel 206 include:

- sub-panel 206*a* that substantially conforms to the shape and size of the central sub-panels 203*a*; and
- sub-panel 206*b* that at least partly conforms to shape and size of the central panel 201.

The sub-panels of roll-over panel 206' include:

sub-panel 206*a*' that substantially conforms to the shape and size of the central sub-panels 203*a*'; and sub-panel 206*b*' that at least partly conforms to shape and size of the central panel 201.

The sub-panels 206*a*, 206*b* are separated from each other via a seventh fold line f7. The seventh fold line f7 extends parallel to the sixth fold lines f6 and second fold lines f2.

The sub-panels 206*a*', 206*b*' are separated from each other via a seventh fold line f7. The seventh fold line f7 extends parallel to the sixth fold lines f6 and second fold lines f2. In an alternate embodiment (not shown) there is only one roll-over panel 206, which projects from either of the side sub-panels 203*a*, 203*a*'. In this embodiment, the roll-over panel 206 comprises three sub-panels, conforming to the two side sub-panels 203*a*, 203*a*' and the central panel 201 of the blank 200.

The side panels 203 are separated from the end panels 202 by a series of cut lines (c1-c4) best illustrated in FIG. 6, wherein:

c1 lies along the boundary between sub-panels 202*d* and sub-panels 203*b;* c2 lies along the boundary between sub-panels 202*d*' and sub-panels 203*c;* c3 lies along the boundary between sub-panels 202*e*' and sub-panels 203*c*'; and c4 lies along the boundary between sub-panels 202*e* and sub-panels 203*b'*.

A preferred method of assembling the container 10 from the blank 200 will now be described with reference to FIGS. 7A to 7K. It is to be understood; however, that not all the steps below are required, nor is the sequence in which they are presented.

Figure 7A:
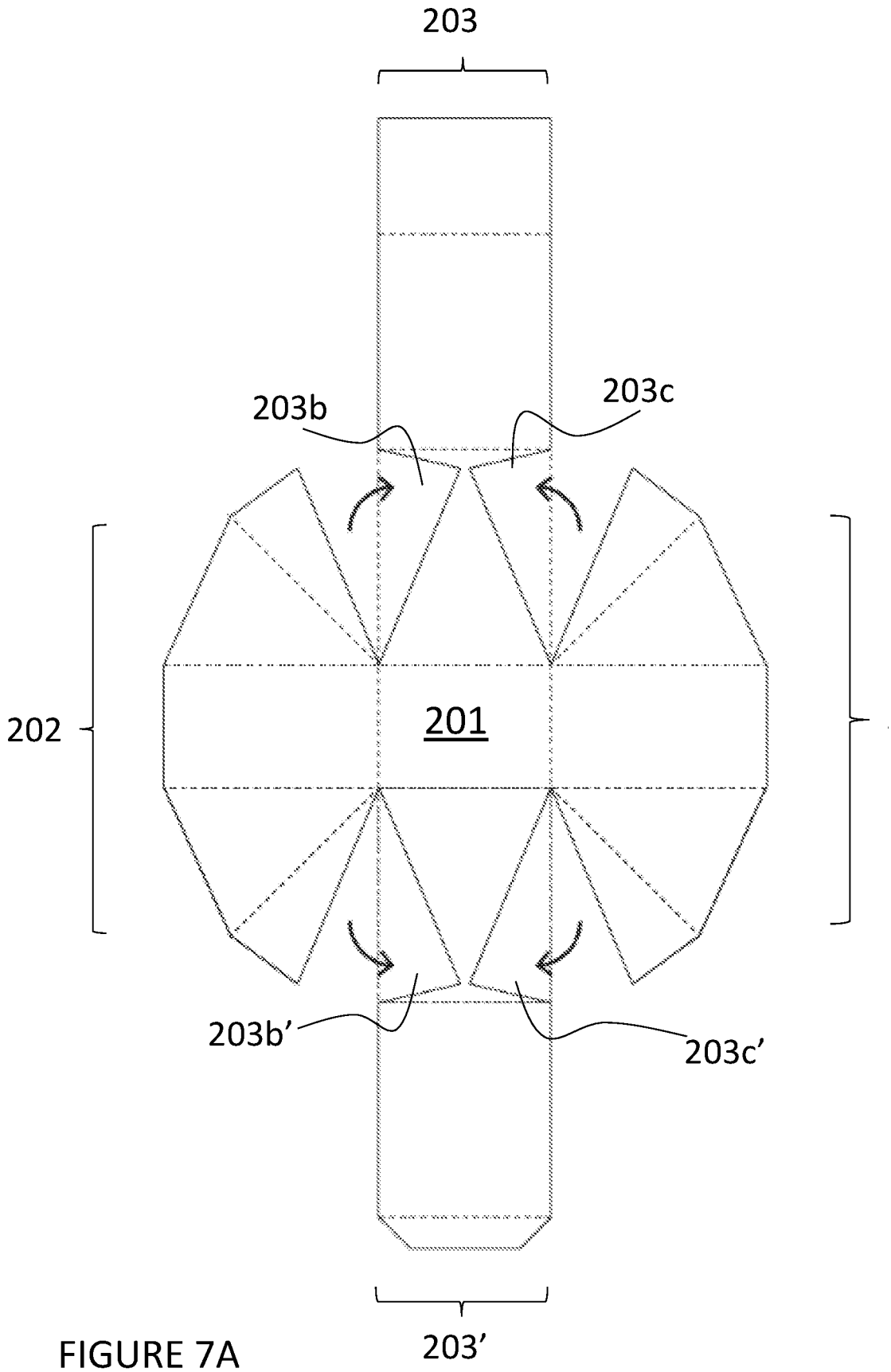
FIGS. 7A to 7K are schematic views of the blank of FIG. 6, illustrating sequential stages in forming the foldable container of FIGS. 1 and 2 therefrom.

In a first step, the sub-panels 203*b*, 203*c* and 203*b*', 203*c*' of each side panel 203, 203' are folded 180 degrees inwardly relative to the adjacent central sub-panels 203*a*, 203*a*' about the fifth fold lines f5. This step is shown in FIG. 7A. These folded sub-panels 203*b*, 203*c* will be referred to as tabs 205 and the folded sub-panels 203*b*', 203*c*' will be referred to as tabs 205' (shown in FIG. 7B).

Figure 7B:
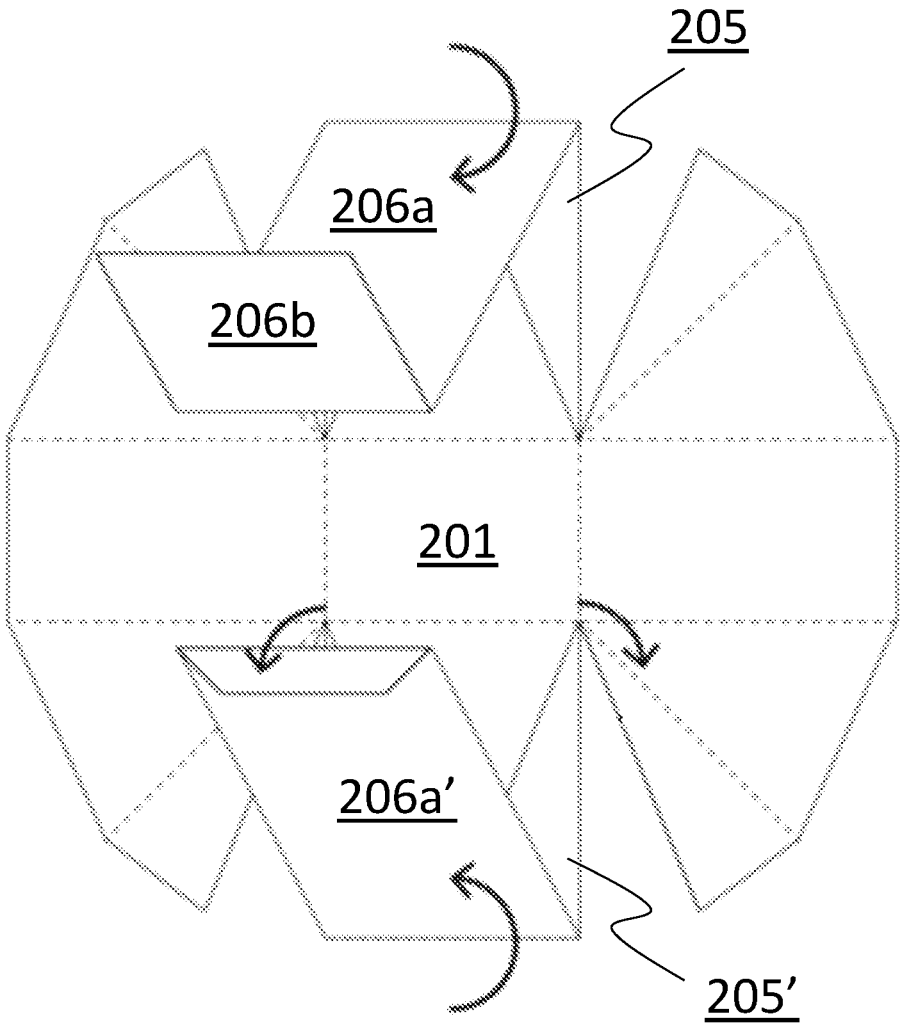

Next, in a second step, sub-panels 206*a*, 206*a*' of each roll-over panel 206 are folded 180 degrees inwardly relative to the respective side sub-panel 203*a*, 203*a*' from which they project. In this way, sub-panels 206*a*,206*a*' cover the folded tabs 205, 205' from the first step. Sub-panels 206*b*, 206*b*' are then folded 90 degrees outwardly relative to sub-panels 206*a*, 206*a*'. In this way, sub-panels 206*b*, 206*b*' project outwardly from a plane of the flat blank 200. This step is shown in FIG. 7B.

Figure 7C:
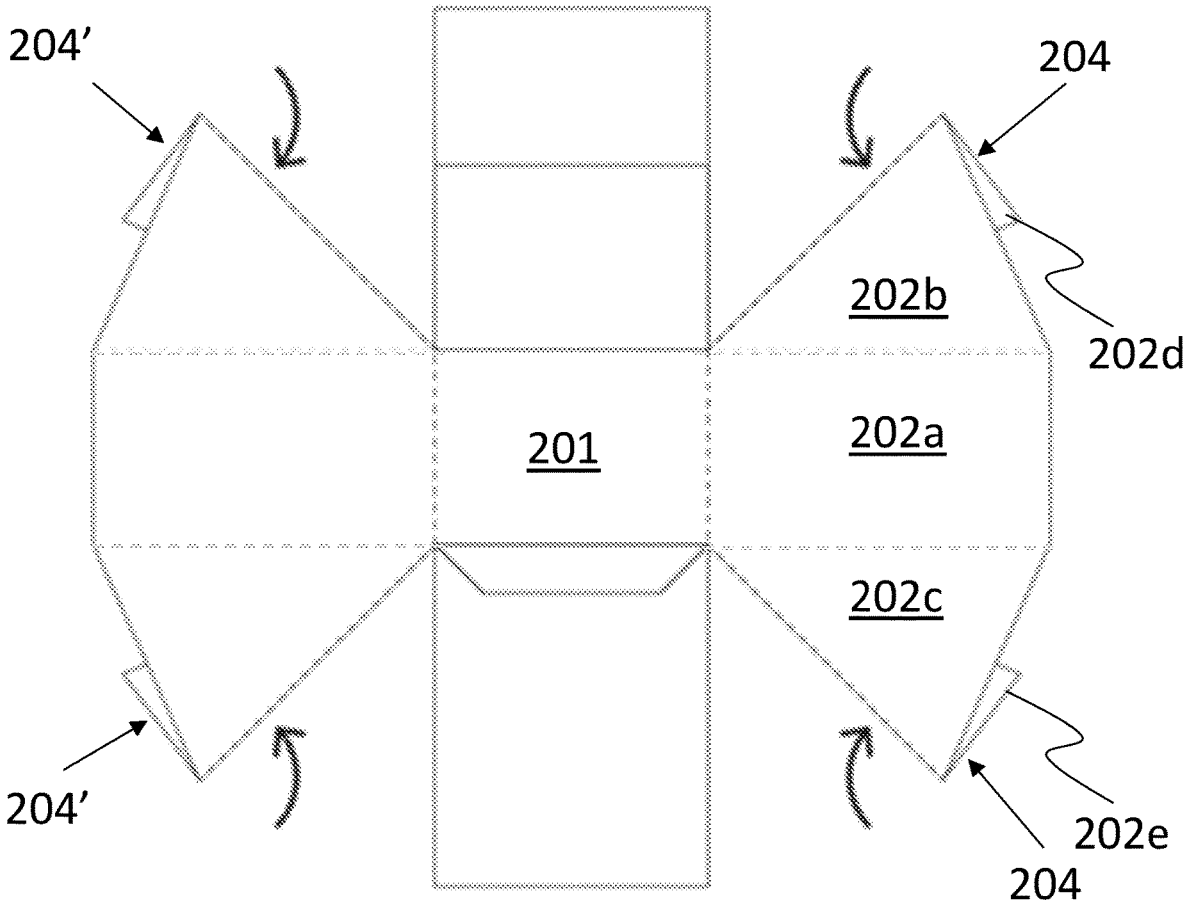
Figure 7D:
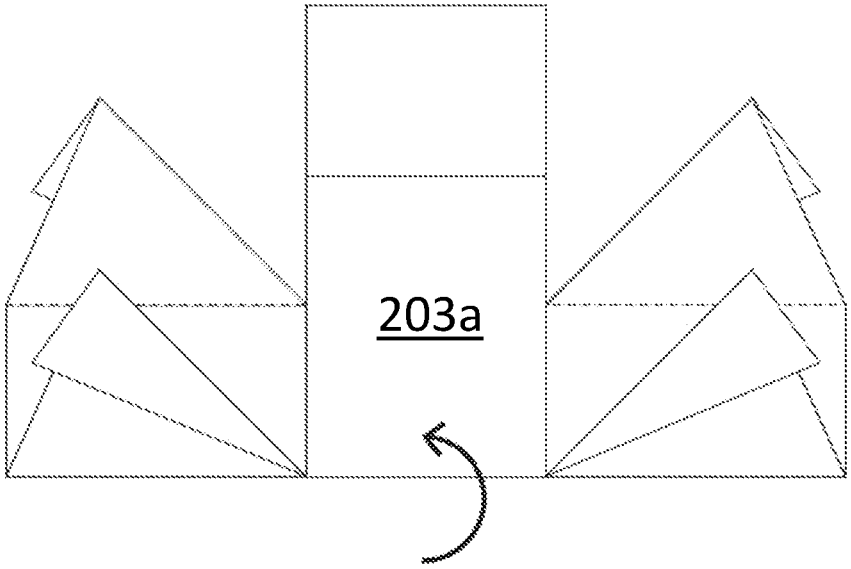
Figure 7E:
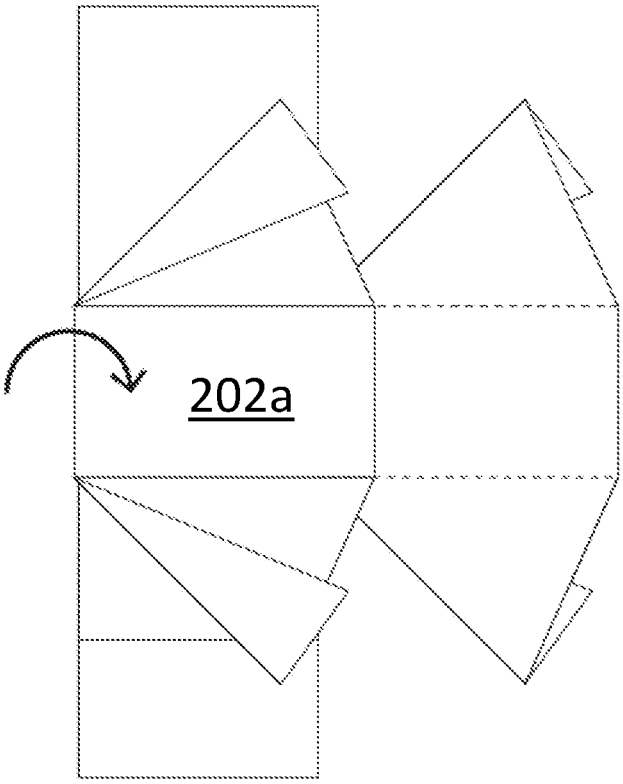
Figure 7F:
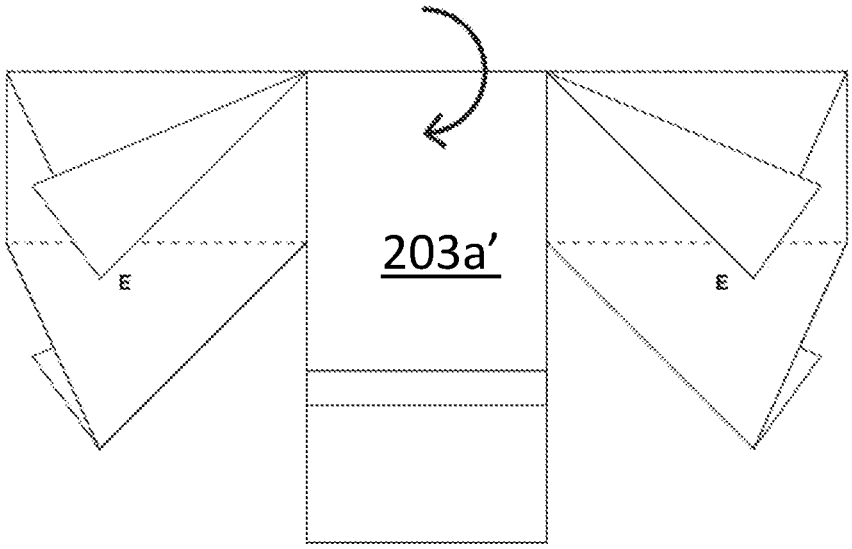
Figure 7G:
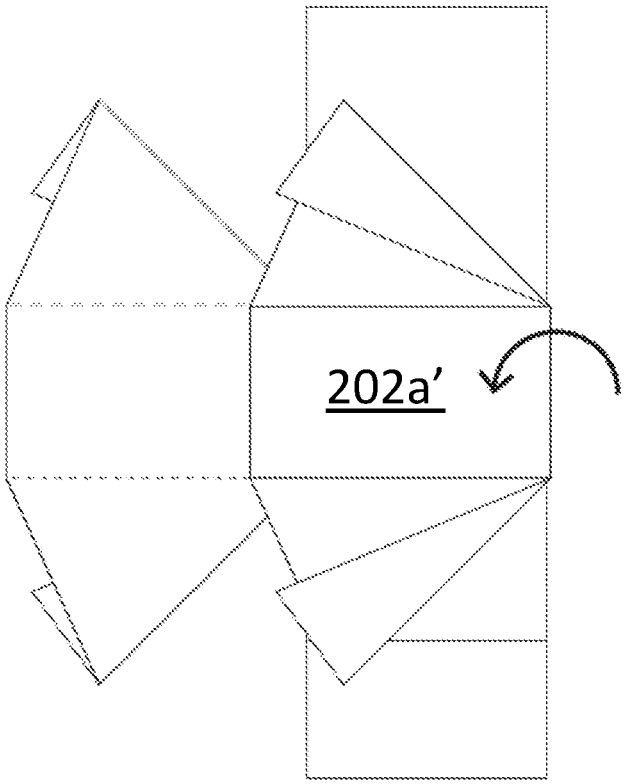

In a third step, the end sub-panels 202*d*,202*d*' and 202*e*, 202*e*' are folded 180 degrees outwardly with respect to their respective end sub-panels 202*a*-202*c* and 202*a*'-202*c*', about fourth fold lines f4. In this way, end sub-panels 202*d*,202*d*', 202*e*,202*e*' are arranged underneath the end sub-panels 202*b*,202*b*' and 202*c*,202*c*' back-to-back. This step is illustrated in FIG. 7C.

The back-to-back folded sections 202*b* and 202*d*, and back-to-back folded sections 202*c* and 202*e* form a pair of triangular pockets 204 on opposing sides of the end sub-panel 202*a*. These pockets 204 will form one side of the interlock means for holding the container 10 in the contracted configuration. A corresponding pair of triangular pockets 204' are formed on opposing sides of end sub-panel 202*a'*.

Next, in a fourth step, the blank 200 is made more pliable by reversibly folding each of the end sub-panels 202*a*,202*a*' about the first fold lines f1. Similarly, each of the side sub-panels 203*a*,203*a*' is reversibly folded about the second fold lines f2. These pre-folding steps are shown in FIGS. 7D to 7G.

Figure 7H:
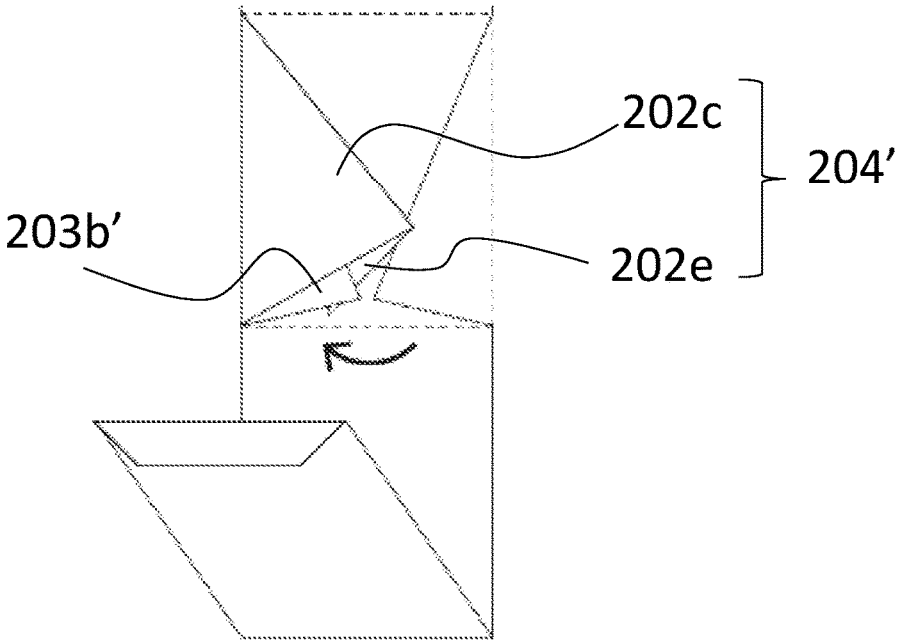
Figure 7I:
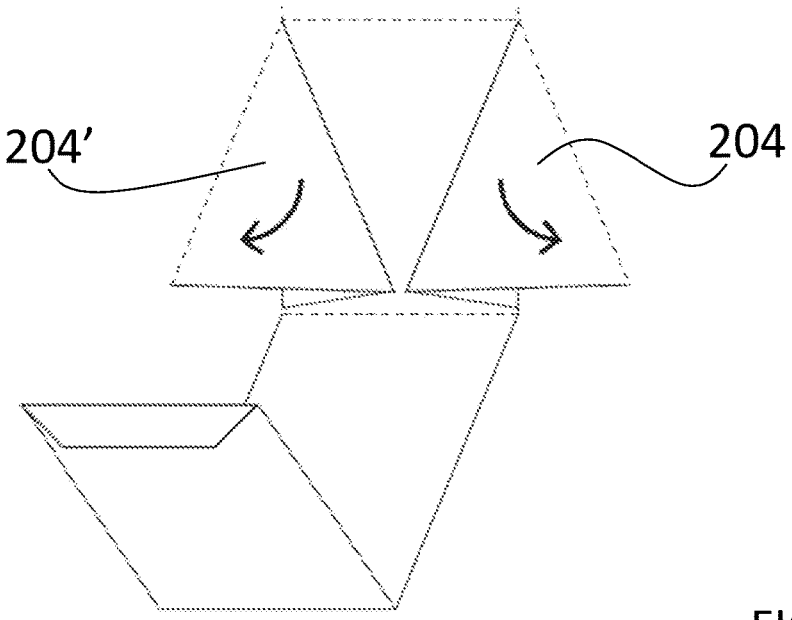

In a fifth step, the end panels 202 are engaged with each of the adjacent side panels 203. Shown in FIG. 7H, for a first of the four wing wall 18 interlocking connections, the side sub-panel 203*b*' (tab 205) is placed within pocket 204, between the folded segments of end sub-panels 202*c* and 202*e*). This step shown in FIG. 7H is repeated for the remaining three tabs 205,205' placing them each within one of the respective pockets 204, 204'.

To capture the tabs 205 within respective pockets 204, 204', the sub-panels 203*b*,203*c*, are eased outwardly to be inserted into the pockets 204,204' thereby interlocking together the first side panel 203 with each of the adjacent end panels 202, 202'. This process is then repeated for the opposing side panel 203' to capture tabs 205' (sub-panels 203*b*',203*c*') into respective pockets 204,204'. During this step, the end panels 202,202' and side panels 203,203' become upstanding, with the side walls 14 forming a 90-degree angle with the central panel 201 and the end panels 202 being held at an inclined angle relative to the central panel 201. Notably, the interlocking of the end panels 202 and side panels 203 is via engagement of the tabs 205,205' (sub-panels 203*b*, 203*c* and 203*b*', 203*c*') with the pockets 204, 204' only and does not require adhesive.

Figure 7J:
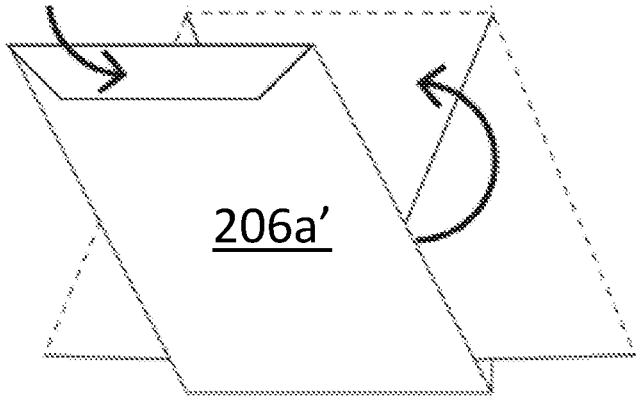

Next, in a sixth step, each of the roll over panels 206, 206' is folded inwardly over the side panels 203, such that sub-panels 206*a*,206*a*' are arranged front-to-front with the side sub-panels 203*a*, 203*a*' of the respective side panels 203,203'. Sub-panels 206*b*,206*b*' are then laid front-to-front upon the central panel 201 that forms the base 12 of the container 10. This is shown in FIG. 7J. At the completion of this stage, a container 10 in the second extended configuration is formed. Specifically, the end panels 202 and side panels 203 provide end walls 13 and side walls 14 respectively, with the central panel 201 providing the base 12. The pockets 204,204' provide the wing walls 18 whilst the roll over panels 206,206' provide the lining 17.

Figure 7K:
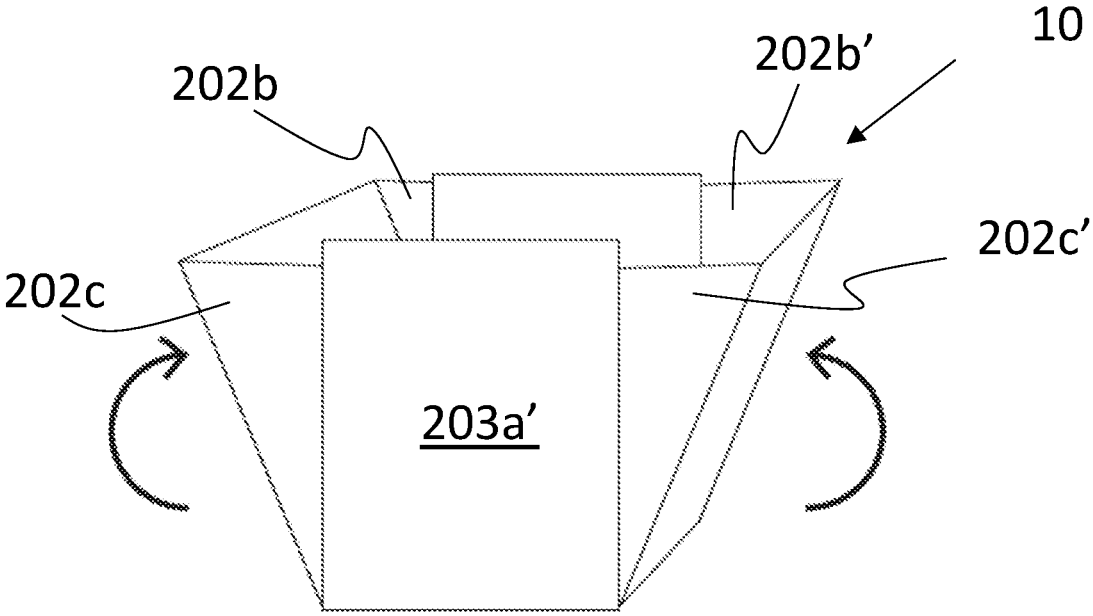

In a seventh and final step, the end panels 202,202' are pushed inwardly (see FIG. 7K). During this step, the pockets 204,204 (formed in part by the wing walls 18) move inwardly under the roll over panels 206,206'. This movement draws the end sub-panels 202*a*,202*a*' upwardly, until they create a 90-degree upstanding angle with respect to the central panel 201. At the completion of this stage, a container 10 in the first, contracted configuration is formed.

When transitioned to the second, expanded configuration, each of the cut lines c1-c4 is pressed against a respective fold line f4, restraining the end walls 13 from being extended further (ie. rotated further in relation to the base 12). As the container 10 is transitioned back towards the contracted configuration, the tabs 205,205' (sub-panels 203*b*, 203*c* and 203*b*', 203*c*') slide within their respective pockets 204,204' until the end walls 13 return to an upright orientation (perpendicular to the base 12).

The sliding motion of the tabs 205,205' within the pockets 204,204' is maintained as a linear motion by virtue of the roll-over panels 206, 206' as explained in the sixth step. Essentially, each wing wall 18 is interleaved between respective side sub-panels 203*a*,203*a*' and the adjacent roll-over sub-panels 206*a*,206*a*'. As the wing walls 18 are pivoted against the base 12, a contact edge 207 of each wing wall 18 emerges from the lining 17. As the contact edges 207 reach an orientation parallel to the base 12 the cut lines c1-c4 meet each of the respective fold lines f4 forming the interlock mechanism and retraining the wing walls 18 from further rotation about the base 12.

It is to be understood that the interlocking of the end panels 202 and side panels 203 for blank 200 comprise two distinct mechanisms. The first interlock mechanism is via the engagement of the interleaved tabs 205,205' (sub-panels 203*b*, 203*c* and 203*b*', 203*c*') and pockets 204,204'. The second interlock mechanism is through the bias of the rollover panels 206,206' pressing against the side panels 203, 203'. This bias results in the roll over panels 206, 206' pressing against the respective side panels 203,203' thereby compressing together the first interlock mechanism and holding the wing walls 18 captive therebetween. This dual-acting interlock mechanism provides a particularly strong and robust movement mechanism. Furthermore, over extension of the end walls 13 is prevented via the retention of the tabs 205,205' (sub-panels 203*b*, 203*c* and 203*b*', 203*c*') within the pockets 204,204'.

Figure 8:
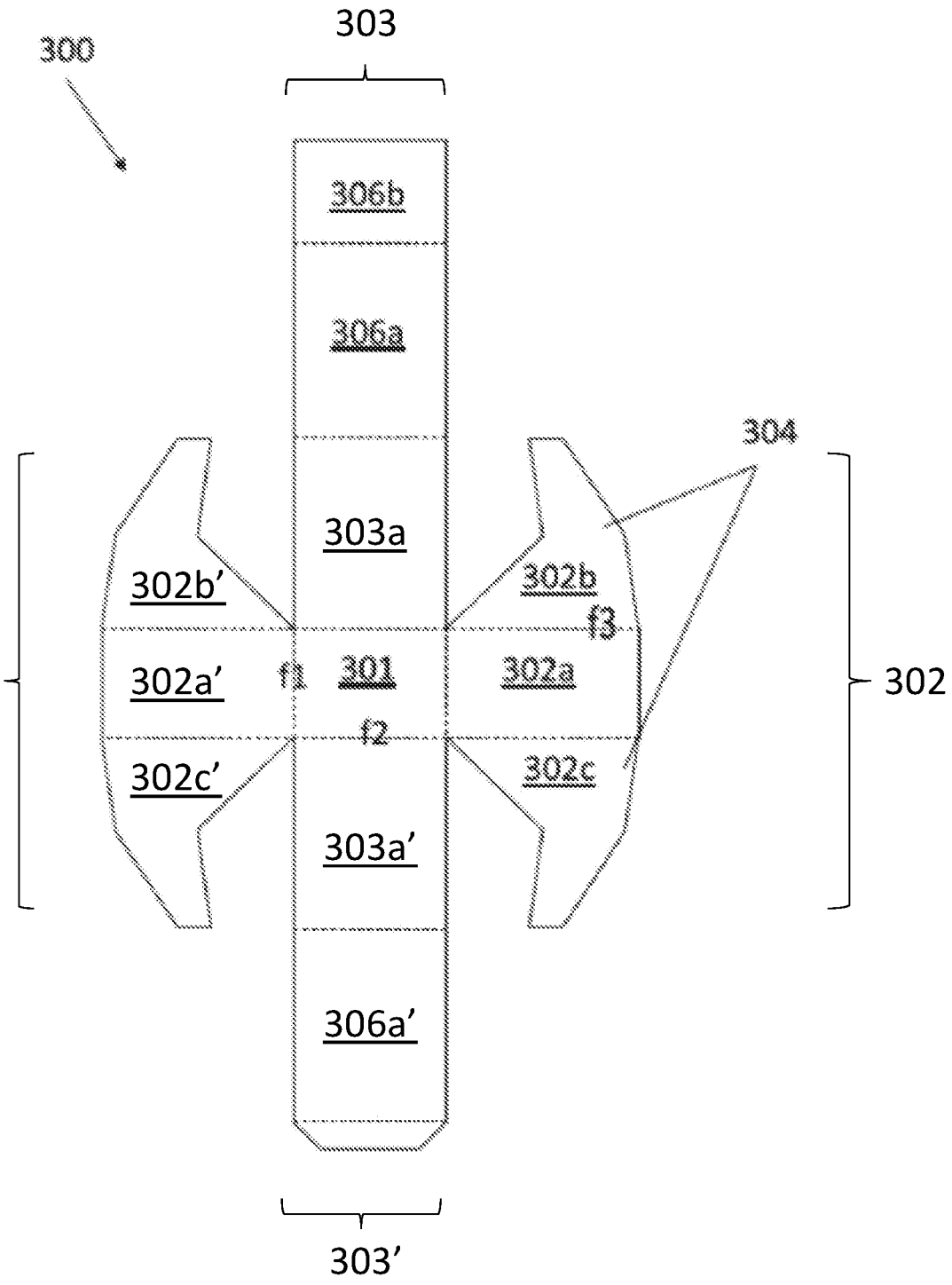
FIG. 8 is a plan view of an alternative blank for forming the foldable container of FIGS. 1 and 2.

It is to be understood that other geometries of blank can also produce foldable container 10. One such alternative is shown in FIG. 8.

Like blank 200, blank 300 also includes a generally rectangular central panel 301, with a pair of end panels 302 and a pair of side panels 303,303' extending adjacently from perimeter edges thereof. The pair of end panels 302,302' are separated from the central panel 301 via first fold lines f1 that extend along opposing side edges of the central panel 301. The pair of side panels 303,303' are separated from the central panel 301 via second fold lines f2 that extend along opposing upper and lower edges of the central panel 301.

Blank 300 differs from blank 200 in the way in which the end panels 302 interlock with the side panels 303. Unlike blank 200, blank 300 does not include any tabs 205,205' extending from the side panels 303.

Furthermore, the geometry of the sub-panels that together make up the end panels 302, 302' is different to blank 200. Specifically, the end panels 302,302' of blank 300 comprise only three sub-panels. The sub-panels of end panel 302 include:

- a generally rectangular central sub-panel 302*a* that is separated from the base 301 by the first fold line f1; and
- V-shaped sub-panels 302*b*, 302*c* that project from upper and lower edges of the sub-panel 302*a*, being separated therefrom by third fold lines f3.

The sub-panels of end panel 302' include:

- a generally rectangular central sub-panel 302*a*' that is separated from the base 301 by the first fold line f1; and
- V-shaped sub-panels 302*b*', 302*c*' that project from upper and lower edges of the sub-panel 302*a*', being separated therefrom by third fold lines f3.

The interlocking of the side panels 303 and end panels 302 of blank 300 is thus achieved solely via the bias of the roll over panels 306,306', that press the sub-panels 302*b*, 302*c*,302*b*',302*c*' (collectively referred to as flaps 304) against the respective side panels 303,303'. An advantage of this blank 300 is the less complex geometry which leads to a simpler folding process to form the assembled container 10.

FIGS. 9A-9D show an embodiment of a locking closer 400. A blank of the closer 400 is generally cross shaped or "cruciform" having a plurality of panels extending from each side of a quadrilateral base 411. The plurality of panels is separated by fold or score lines. The closer 400 comprises: a lid portion 410 for covering the opening 16 of container 10; a band portion 420 for wrapping around the container 10 to retain the lid portion 410 in place during use; and a locking portion 427, 430 for securing the closer 400 in position around the container 10.

Figure 9A:
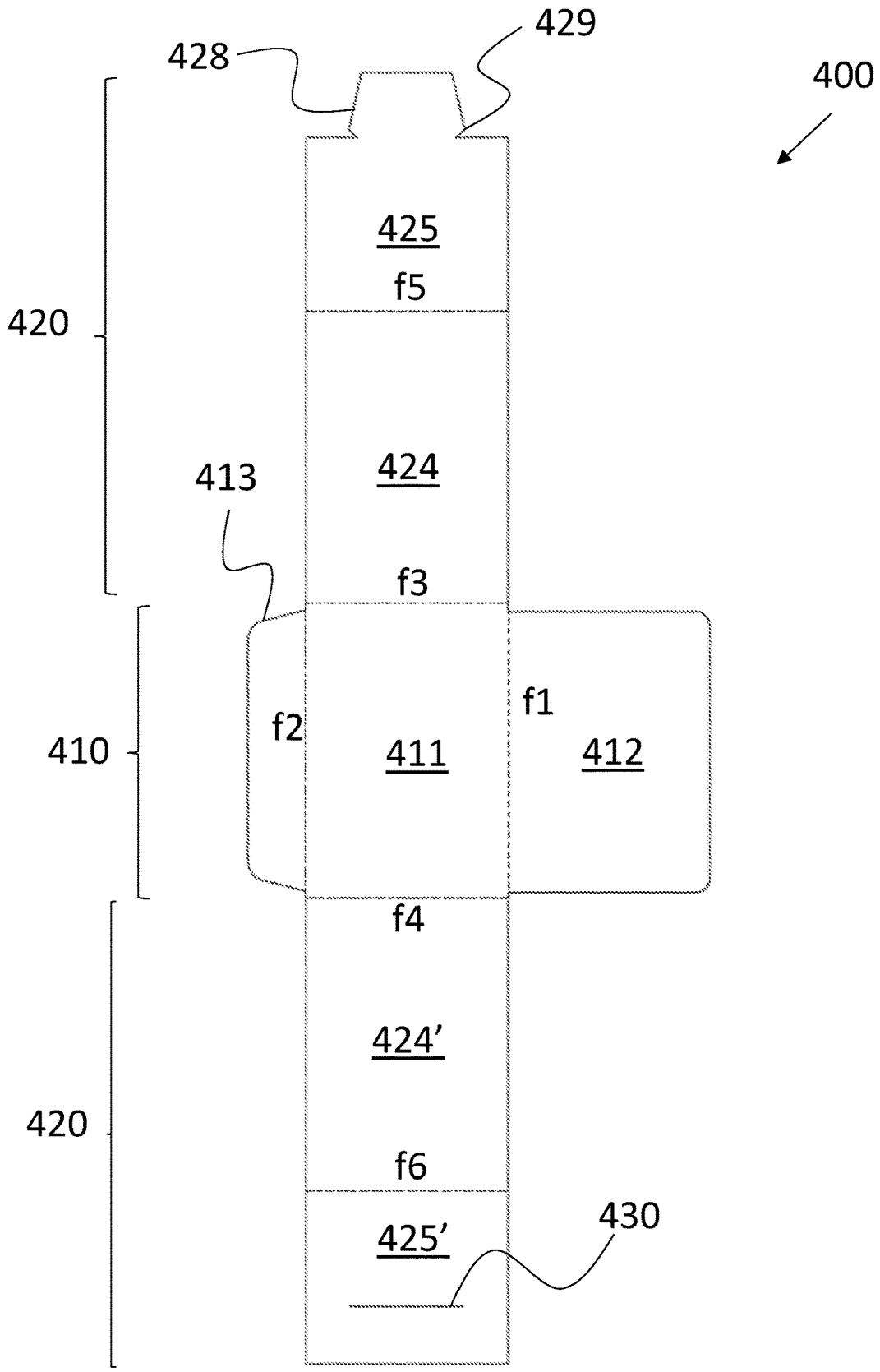
FIG. 9A is a plan view of a blank for forming a locking closer, the locking closer preventing the container from transitioning between the contracted configuration and the expanded configuration when engaged with the container.

With reference to FIG. 9A, the lid portion 410 comprises a central panel 411 having a first side panel 412 and a second side panel 413. The first and second side panels 412, 413 outwardly extend from the central panel 411 on opposing sides thereof. The first and second side panels 412, 413 are separated from the central panel 411 by fold lines f1 and f2, respectively.

The first and second side panels 412, 413 can be of similar size but need not be. The first and second panels 412, 413 are quadrilateral having a similar length to a common edge of the central panel 411 from which they extend. The common edge between the first side panel 412 and the central panel 411 is fold line f1. The common edge between the second side panel 413 and the central panel 411 is fold line f2 (see FIG. 9A).

A pair of end panels 424,424' extend from the central panel 411 in the remaining opposing directions from the first and second side panels 412, 413. Adjacent to end panels 424,424' are base panels 425,425'. Together end panels and base panels 424,424',425,425' form the band portion 420.

The first end panel 424 is joined to the central panel 411 along a common edge, fold line f3, while the second end panel 424' is joined to the central panel 411 along a common edge, fold line f4. The first base panel 425 is joined to the first end panel 424 along a common edge, fold line f5, while the second base panel 425' is joined to the second end panel 424' along a common edge, fold line f6.

The base panels 425, 425' together provide locking means for the closer 400, with a first of the base panels 425 providing a tab 428 and the second of the base panels 425' providing a slit or slot 430 for receiving the tab 428 therein.

The tab 428 extends from the base panel 425 and can be rounded or chamfered for ease of connection with the slot 430. The tab 428 can provide a pair of undercut shoulders 429 for retaining the tab 428 within the slot 430 and holding the closer 400 around the container 10.

A method of coupling the closer 400 to the container 10 will now be described with reference to FIGS. 9B-9D.

Figure 9B:
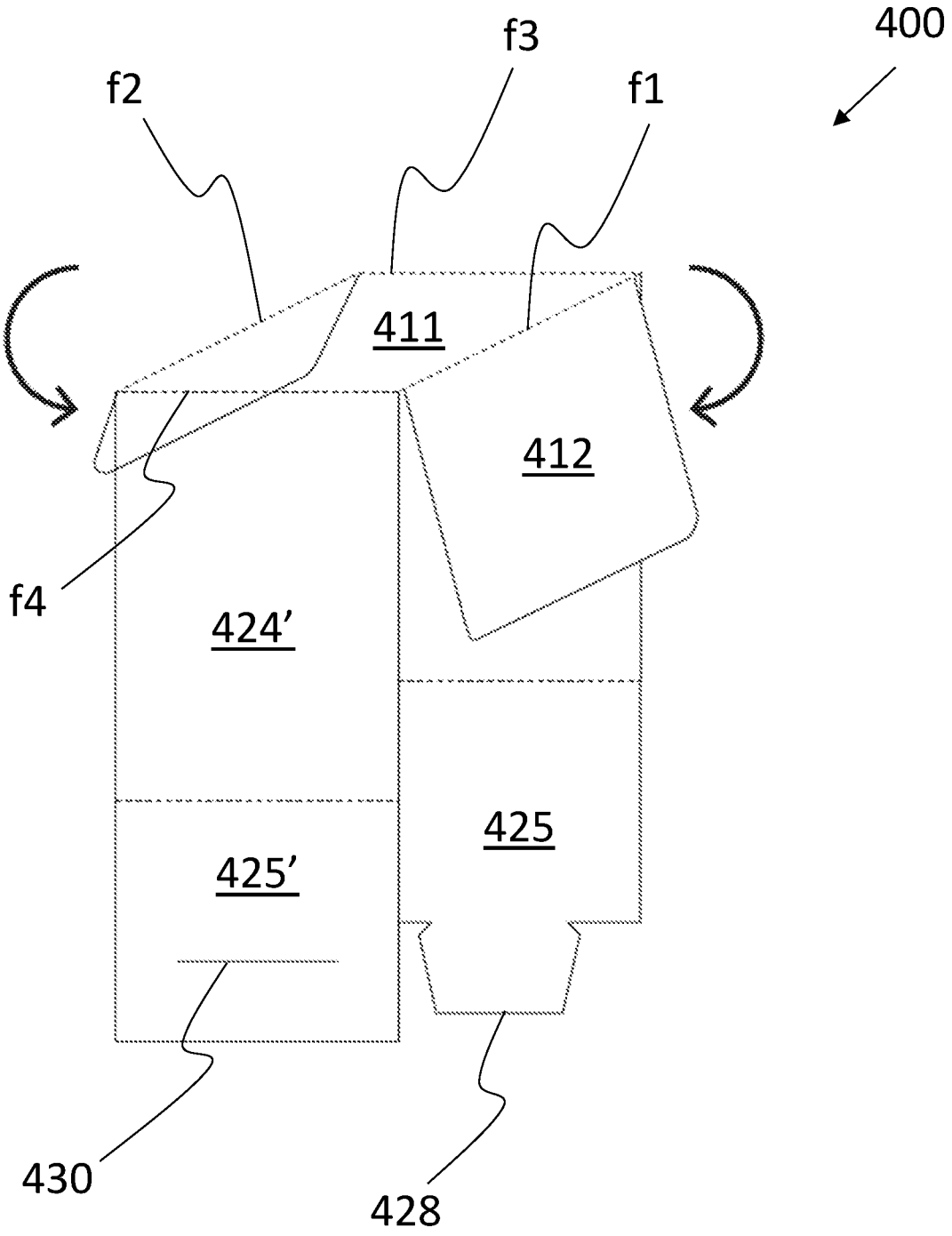
FIGS. 9B to 9D are a series of perspective views illustrating sequential stages of forming the locking closer from the blank of FIG. 9A.

In a first step, side panels 412, 413 are folded along fold lines f1, f2 to be substantially perpendicular to the central panel 411 and to be substantially parallel with each other (see FIG. 9B).

Figure 9C:
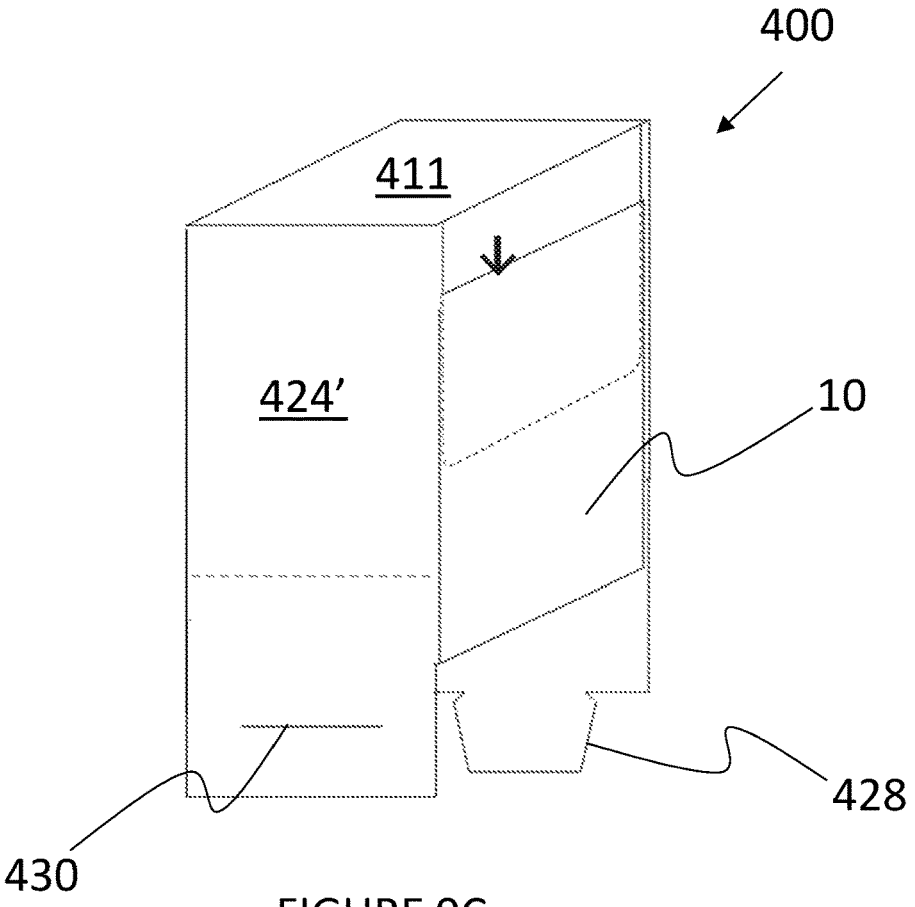

In a second step, the side panels 412, 413 are inserted through opening 16 of container 10 such that the central panel 411 seals the space 15 of the container 10 as shown in FIG. 9C. In this position, the side panels 412, 413 lie flat against the lining 17 (206*a*,206*a*') of the container. Shown in FIG. 9A, the width of side panels 412, 413 are marginally less that a width of the central panel 411, to facilitate the side panels 412, 413 being inserted inside the space 15 within the container 10. A length of central panel 411 is dimensioned to be marginally greater than the opening 16 of the container 10 such that a periphery of central panel 411 overlays the opening 16 of the container 10 cover opening 16 and preventing stored items from exiting the container 10.

In a third step, the end panels 424,424' are folded downwards along fold lines f3, f4 to be substantially perpendicular to the central panel 411 and to abut the end walls 13 of the container 10. A length of the end panels 424,424' is marginally greater that a length D of lengths of the side walls 13 enabling the end panels to snugly wrap around the container 10.

Figure 9D:
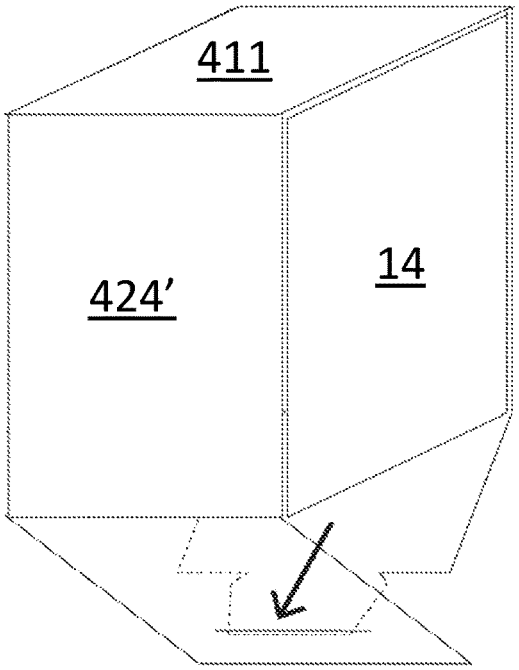

In a fourth step, the base panels 425, 425' are folded along fold lines f5 and f6 to lie atop one another abutting the base 12 of the container 10 and to be substantially parallel to the central panel 411, as shown in FIG. 9D.

The tab 428 is inserted into the slot 430 such that the shoulders 429 engage with the slot preventing the tab 428 from sliding out of the slot 430, thereby locking the closer 400 about the container 10 and sealing the opening 16 thereof.

The locking closer 400 can be used in combination with the band 103 to form an alternative packaging unit, thereby sealing the container 10, and preventing the locking closer 400 becoming detached. In this embodiment, the band 103 is applied to the locked container 10 such that the band lies perpendicular to the closer 400, thereby providing a criss-crossed wrapping appearance to the container 10.

The band 103 can be branded with logos or information in relation to the stored contents. This embodiment of the packaging unit requires less material than packaging unit 100 and is therefore less damaging to the environment.

Returning to the expandable container 11 of FIG. 3. The container 11 is a foldable container and is formed from a flat blank 500. The following paragraphs will now describe the flat blank 500 from which the container 11 is assembled and describe a series of steps/stages by which the container 11 is formed from the flat blank. The flat blank 500 facilities ease of transport of the containers 11 and allows an end user to erect the containers from a stack of blanks one at a time as required.

FIGS. 10A-10F show the blank 500 for making the container 11 as described herein. The blank 500 is formed from a foldable material such as cardboard and includes a plurality of panels separated by fold or score lines. The fold lines are illustrated in the FIGS. 10A-10F in dashed outline. It is contemplated that the fold lines can be pre-scored to facilitate easier assembly. Also, it is contemplated that the fold lines are pre-marked. In contrast, cut lines are shown in solid line.

The blank 500 includes a generally rectangular central panel J, with a pair of end panels 502,502' and a pair of side panels 503,503' extending adjacently from perimeter edges thereof. In the illustrated embodiment, the first pair of end panels 502,502' provide end walls 13, being separated from the central panel J via first fold lines f1 that extend along top and bottom edges of the central panel J. The pair of side panels 503,503' provide side walls 14, being separated from the central panel J via second fold lines f2 that extend along respective side edges of the central panel J.

Figure 10A:
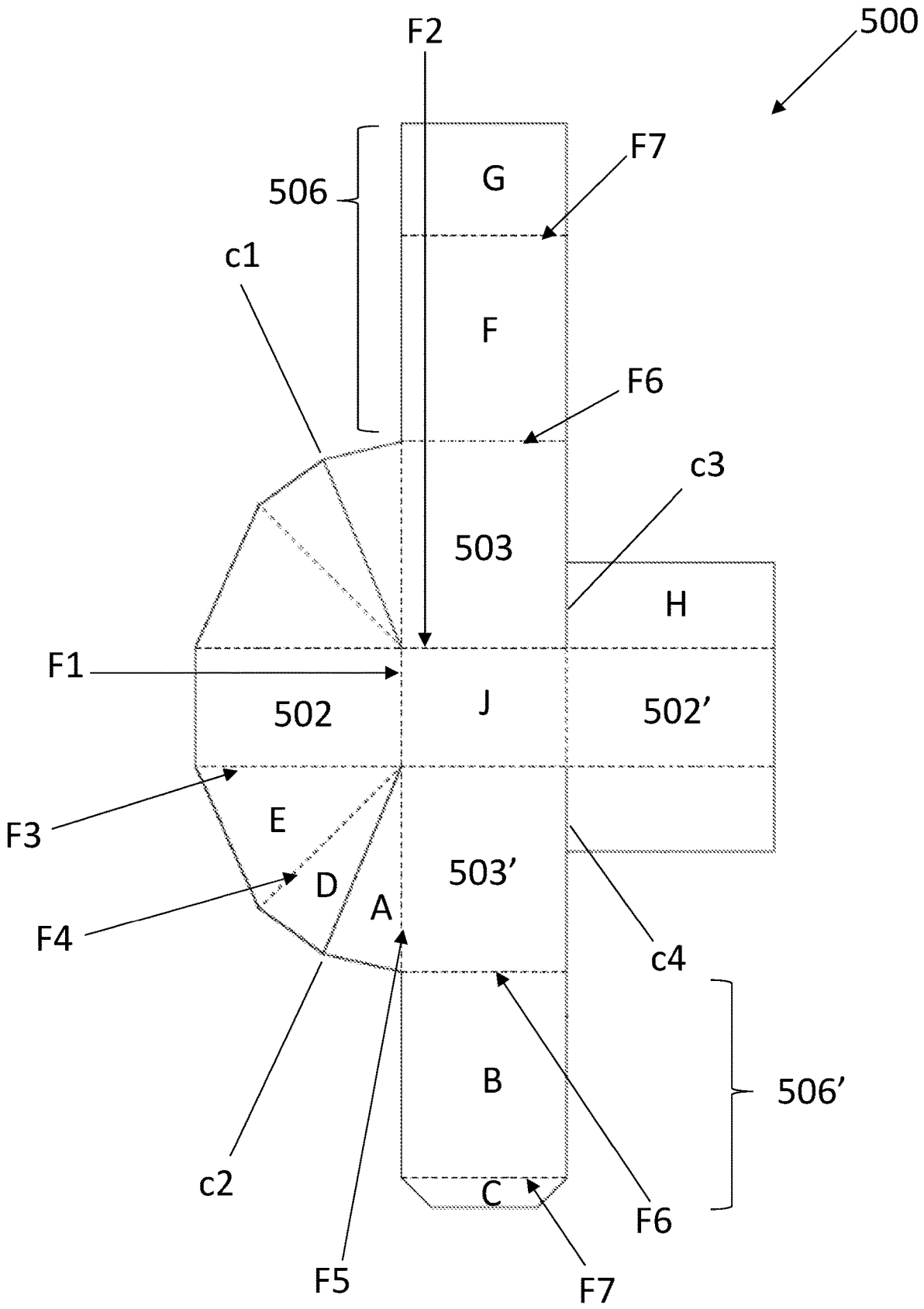
FIG. 10A is a plan view of a blank according to another embodiment of the invention, the blank being suitable for forming the foldable container of FIG. 3.
Figure 10B:
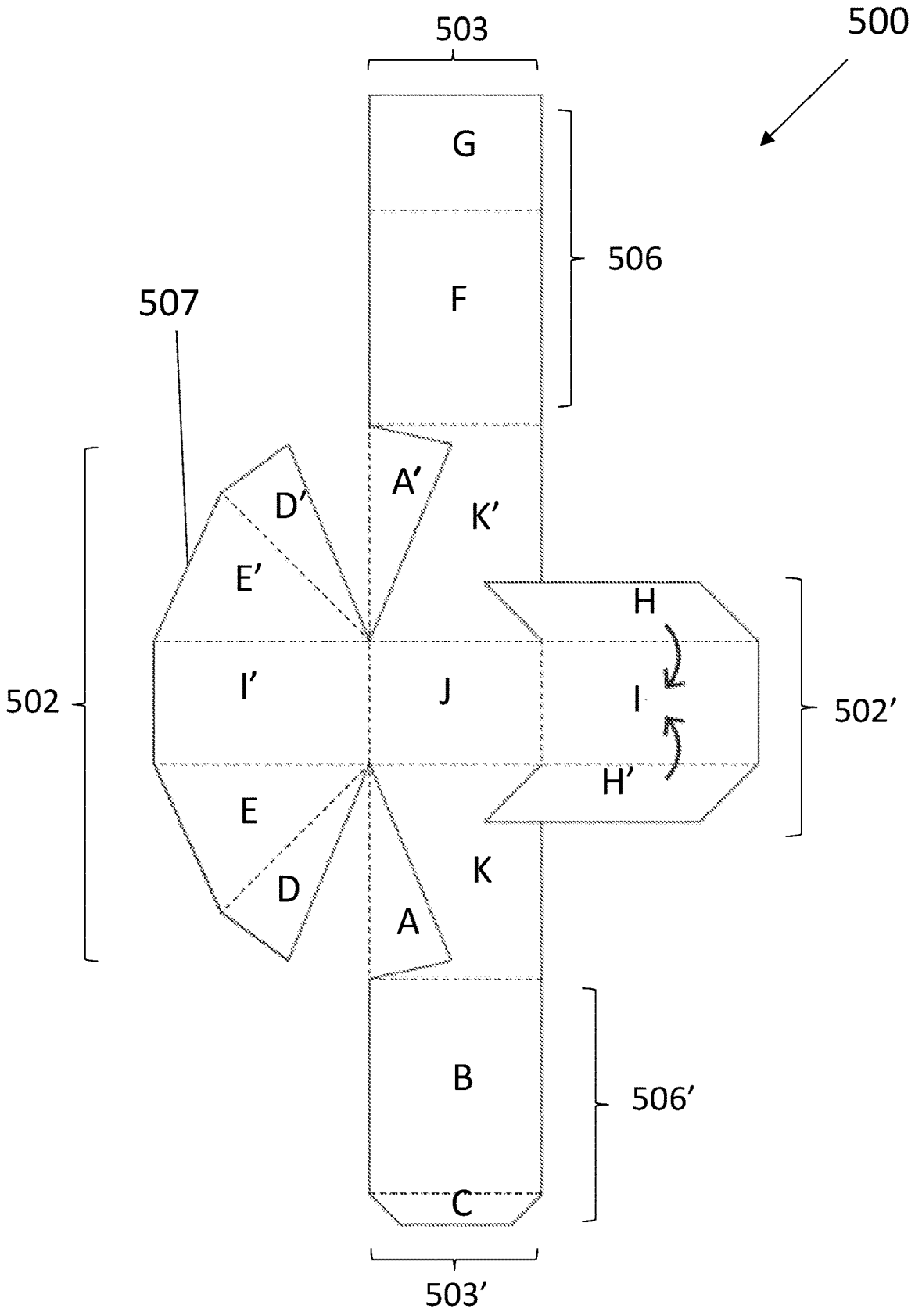
FIGS. 10B-10F are schematic views of the blank of FIG. 10A, illustrating sequential stages in forming the foldable container of FIG. 3 therefrom.

End panel 502 comprises five sub-panels D, E, I', D', E' (see FIG. 10B). The sub-panels of end panel 502 include:

- a generally rectangular central sub-panel I' that is separated from the base J by the first fold line f1;
- generally triangular sub-panels E,E' that project from upper and lower edges of the sub-panel I', being separated therefrom by third fold line f3. The third fold lines f3 are parallel to the second fold lines f2 and form a continuation thereof; and
- generally triangular sub-panels D,D' that project respectively from sub-panels E,E', being separated therefrom by a fourth fold line f4. The fourth fold lines f4 extend from the central panel J, forming approximately a 45-degree angle with the third fold line f3. With specific reference to the illustrated embodiment, sub-panels D, D' are generally smaller than sub-panels E, E'.

End panel 502' comprises three sub-panels. The sub-panels of end panel 502' include:

- a generally rectangular central sub-panel I that is separated from the base J by the first fold line f1; and
- two generally rectangular sub-panels H, H' that project from upper and lower edges of the sub-panel I, being separated therefrom by third fold line f3. The third fold lines f3 are parallel to the second fold lines f2 and form a continuation thereof.

Together, sub-panels E,D form a first wing wall 18 and sub-panels E',D' form a second wing wall 18; together forming a first pair of wing walls 18*a*. Each wing wall 18 of the pair of wing walls 18*a* is substantially triangular in shape.

Each of the side panels 503, 503' comprises two sub-panels. The sub-panels of side panel 503 include sub-panels A, K:

- a generally rectangular central sub-panel K that is separated from the base J by the second fold line f2; and
- generally triangular sub-panel A that projects from a first side edges of the sub-panel K, being separated therefrom by fifth fold lines f5. The fifth fold lines f5 are parallel to the first fold lines f1 and form a continuation thereof.

The sub-panels of side panel 503' include sub-panels A', K':

- a generally rectangular central sub-panel K' that is separated from the base J by the second fold line f2; and
- generally triangular sub-panel A' that projects from a first side edges of the sub-panel K', being separated therefrom by fifth fold lines f5. The fifth fold lines f5 are parallel to the first fold lines f1 and form a continuation thereof.

The blank 500 further includes at least one roll-over panel 506. The roll-over panel 506 is generally rectangular and projects from one of side panels 503, 503' being separated therefrom by a sixth fold line f6. The sixth fold lines f6 extend parallel to the second fold lines f2, being spaced therefrom by the respective side panel 503,503'.

In the illustrated embodiment of FIG. 10A, there are two roll-over panels 506,506', with each side panel 503, 503' having a respective roll-over panel 506 projecting therefrom. In this embodiment, the roll-over panel 506 comprises two sub-panels F,G. The sub-panels of roll-over panel 506 include:

- sub-panel F that substantially conforms to the shape and size of the side sub-panel K'; and
- sub-panel G that at least partly conforms to shape and size of the central panel J.

The sub-panels of roll-over panel 506' include:

- sub-panel B that substantially conforms to the shape and size of the side sub-panel K; and
- sub-panel C that at least partly conforms to shape and size of the central panel J.

The sub-panels F,G and B,C are separated from each other via a seventh fold line f7. The seventh fold line f7 extends parallel to the sixth fold lines f6 and second fold lines f2.

In an alternate embodiment (not shown) there is only one roll-over panel 206, which projects from either of the side sub-panels K,K'. In this embodiment, the roll-over panel 206 comprises three sub-panels, conforming to the two side sub-panels K,K' and the central panel J of the blank 500.

The side panels 503,503' are separated from the end panels 502,502' by a series of cut lines (c1-c4) best illustrated in FIG. 10A, wherein:

- c1 lies along the boundary between sub-panel A' and sub-panel D';
- c2 lies along the boundary between sub-panel D and sub-panel A;
- c3 lies along the boundary between sub-panel K' and sub-panel H; and c4 lies along the boundary between sub-panel K and sub-panel H'.

A preferred method of assembling the container 11 from the blank 500 will now be described with reference to FIGS. 10A to 10F. It is to be understood; however, that not all the steps below are required, nor is the sequence in which they are presented.

In a first step, the sub-panels A,A' of each side panel 503, 503' are folded 180 degrees inwardly relative to the adjacent central sub-panels K, K' about the fifth fold lines f5. This step is shown in FIG. 10B. These folded sub-panels A,A' will be referred to as tabs A,A'. Sub-panels H, H' are folded 90 degrees along fold line f3, making them upstanding from the blank 500.

Figure 10C:
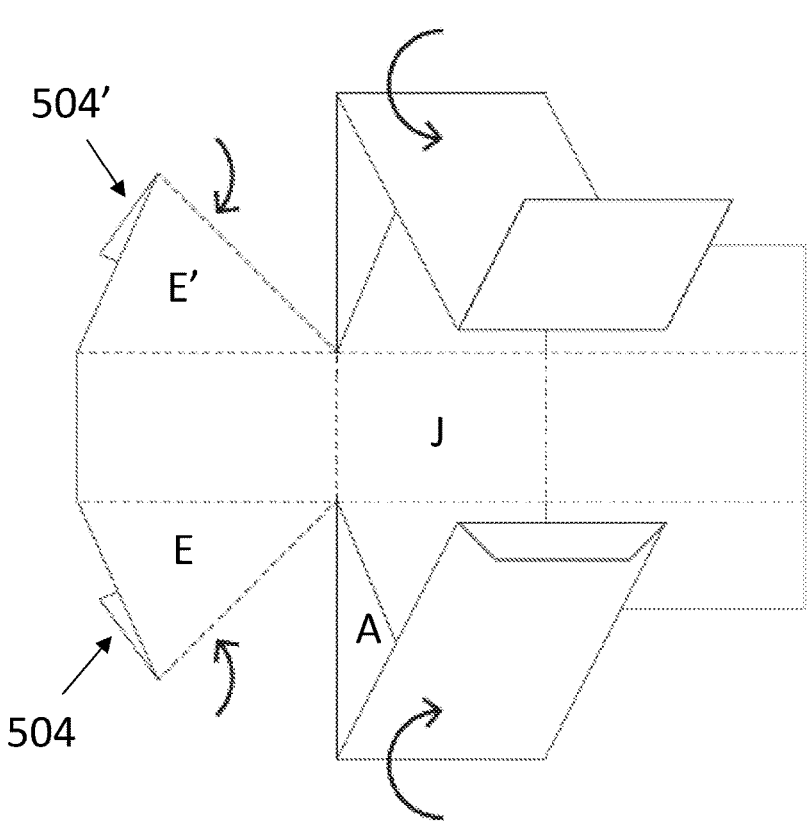

Next, in a second step, sub-panels B,C,F,G, of each roll-over panel 506,506' are folded 180 degrees inwardly relative to the respective side sub-panel K,K' from which they project. In this way, sub-panels B,C,F,G cover the folded tabs A,A' from the first step. Sub-panels G,C are then folded 90 degrees outwardly relative to sub-panels F,B. In this way, sub-panels G,C project outwardly from a plane of the flat blank 500. This step is shown in FIG. 10C.

Figure 10D:
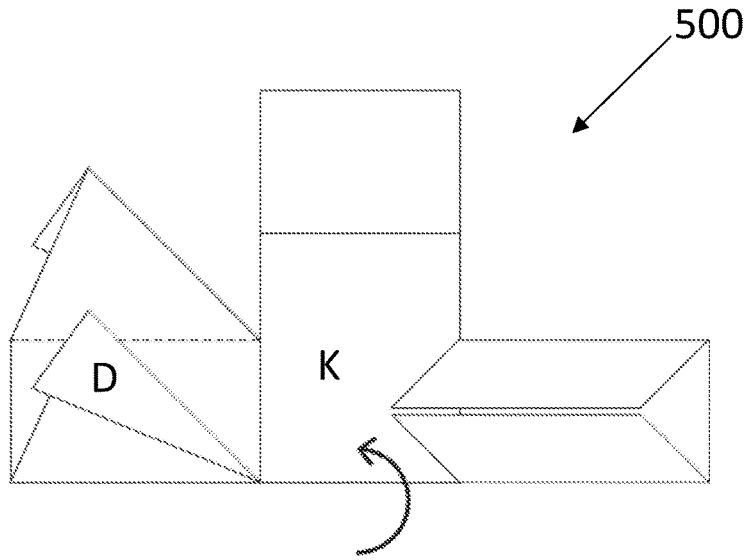
Figure 10E:
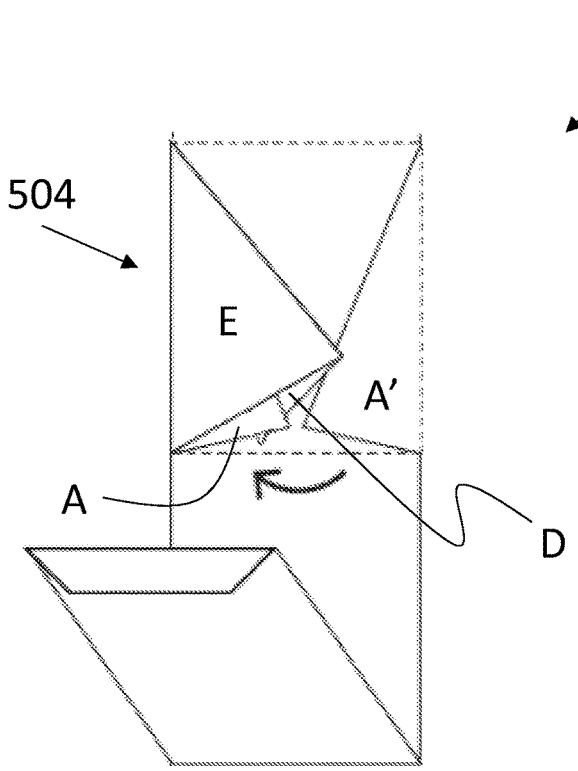

In a third step, the end sub-panels D,D' are folded 180 degrees outwardly with respect to their respective end sub-panels E,E' about fourth fold lines f4. In this way, end sub-panels D,D' are arranged underneath the end sub-panels E,E' back-to-back. This step is illustrated in FIG. 10D.

The back-to-back folded sections D,D', and back-to-back folded sections E,E' form a pair of triangular pockets 504, 504' on opposing sides of the end sub-panel I'. These pockets 504,504' will form one side of the interlock means for holding the container 11 in the contracted configuration.

Next, in a fourth step, the blank 500 is made more pliable by reversibly folding each of the end sub-panels I,I' about the first fold lines f1. Similarly, each of the side sub-panels K,K' is reversibly folded about the second fold lines f2. These pre-folding steps are shown in FIG. 10D.

In a fifth step, the end panels 502 are engaged with each of the adjacent side panels 503,503'. Shown in FIG. 10E for a first of the two wing wall 18 interlocking connections, the side sub-panel A (tab A) is placed within pocket 504, between the folded segments of end sub-panels D,E. This is then repeated for the remaining tab A' placing it within the remaining pocket 504' (folded sub-panels D',E').

Figure 10F:
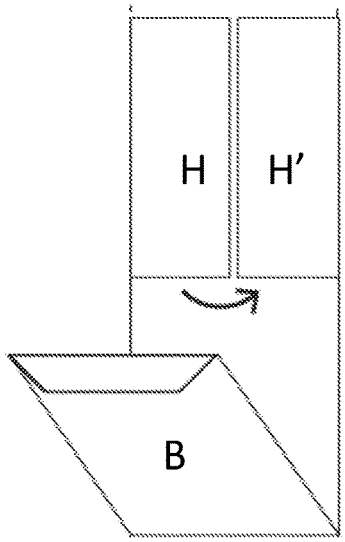

Shown in FIG. 10F the end sub-panels H, H' are folded over the sub-panel I to lie flat thereupon.

To capture the tabs A,A' within respective pockets 504, 504' (D,E and D',E'), the panels A,A' are eased outwardly to be inserted into the pockets 504,504' thereby interlocking together the first end panel 502 with each of the adjacent side panels 503,503'. During this step, the side panels 503,503' and end panel 502 become upstanding, with the side walls 14 forming a 90-degree angle with the central panel J and the end panel 502 being held at an inclined angle relative to the central panel J. Notably, the interlocking of the end panel 502 and side panels 503,503' is via engagement of the tabs A,A' with the pockets 504, 504' only and does not require adhesive.

Next, in a sixth step, each of the roll over panels 506, 506' is folded inwardly over the side panels 503,503' such that sub-panels F,G and B,C are arranged front-to-front with respective side sub-panels K, K' of the respective side panels 503,503'. Sub-panels G,C' are then laid front-to-front upon the central panel J that forms the base 12 of the container 11. At the completion of this stage, a container 11 in the second extended configuration is formed (see FIG. 3). Specifically, the end panels 502 and side panels 503 provide end walls 13 and side walls 14 respectively, with the central panel J providing the base 12. The pockets 504,504' provide the wing walls 18 whilst the roll over panels 506,506' provide the lining 17.

In a seventh and final step, the end panels 502 is pushed inwardly. During this step, the pockets 504,504' (formed in part by the wing walls 18) move inwardly under the roll over panels 506,506'. This movement draws the end sub-panel I' upwardly, until it creates a 90-degree upstanding angle with respect to the central panel J. At the completion of this stage, a container 11 in the first, contracted configuration is formed.

When transitioned to the second, expanded configuration, each of the cut lines c1-c2 is pressed against a respective fold line f4, restraining the end wall 13 from being extended further (ie. rotated further in relation to the base 12). As the container 11 is transitioned back towards the contracted configuration, the tabs A,A' slide within their respective pockets 504,504' until the end wall 13 returns to an upright orientation (perpendicular to the base 12).

The sliding motion of the tabs A,A' within the pockets 504,504' is maintained as a linear motion by virtue of the roll-over panels 506, 506' as explained in the sixth step. Essentially, each wing wall 18 (D,E and D',E') is interleaved between respective side sub-panels K,K' and the adjacent roll-over sub-panels B,F. As the wing walls 18 are pivoted against the base 12, a contact edge 507 of each wing wall 18 emerges from the lining 17. As the contact edges 507 reaches an orientation parallel to the base 12 the cut lines c1, c2 meet the respective fold lines f4 forming the interlock mechanism and retraining the wing walls 18 from further rotation about the base 12.

It is to be understood that the interlocking of the end panel 502 and side panels 503 for blank 500 comprise two distinct mechanisms. The first interlock mechanism is via the engagement of the interleaved tabs A,A' and pockets 504, 504'. The second interlock mechanism is through the bias of the rollover panels 506,506' pressing against the side panels 503, 503'. This bias results in the roll over panels 506, 506' pressing against the respective side panels 503,503' thereby compressing together the first interlock mechanism and holding the wing walls 18 captive therebetween. This dual-acting interlock mechanism provides a particularly strong and robust movement mechanism. Furthermore, over extension of the end wall 13 is prevented via the retention of the tabs A,A' within the pockets 504,504'.

It is to be understood that other geometries of blank can also produce foldable container 11.

The containers 10,11 provide advantages in that there is no requirement for glues, adhesives, cellotape, plastics, pins, rivets, hooks, or the like to hold the container together. The materials to be used can be bare and easily recyclable or impregnated for use with food stuffs, to repel moisture or grease. In addition, the material of the blank can provide differing properties on opposing sides, as desired for presentation and protection of the stored product therein. In still further embodiments, the material of the blank 200, 300, 500 can be highly ornate, or textured for a tactile or aesthetic appearance to the container 10.

It is understood that the foldable containers 10,11 as described herein are transitional between two distinct configurations, providing for increased utility and usability. The blanks 200, 300, 500 described herein provide for an easy and simple method of assembling said container, and do not require the use of glue or adhesive to form it.

It will be appreciated by persons skilled in the art that numerous variations and modifications may be made to the above-described embodiments, without departing from the scope of the following claims. The present embodiments are, therefore, to be considered in all respects as illustrative of the scope of protection, and not restrictively.

Unless defined otherwise, all technical and scientific terms used herein have the same meaning as commonly understood by one of ordinary skill in the art to which this invention belongs. Although any methods and materials similar or equivalent to those described herein can also be used in the practice or testing of the present invention, a limited number of the example methods and materials are described herein.

It is to be understood that, if any prior art publication is referred to herein, such reference does not constitute an admission that the publication forms a part of the common general knowledge in the art, in Australia or any other country.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

LEGEND

| # No. | Name | # No. | Name |
|---|---|---|---|
| 10 | Double ended container | 300 | Blank |
| 11 | Single ended container | 301 | Central Panel |
| 12 | Base | 302 | End Panels |
| 13 | End Walls | 303 | Side Panels |
| 14 | Side Walls | 304 | Pockets |
| 15 | Internal Space | 306 | Roll-Over Panels |
| 16 | Opening | 400 | Closer |
| 17 | Lining | 410 | Lid |
| 18 | Wing Walls | 411 | Central panel |
| 100 | Packaging Unit | 412 | First side panel |
| 101 | Upper Component | 413 | Second side panel |
| 102 | Lower Component | 420 | Band |
| 103 | Band | 424 | Side panel |
| 200 | Blank | 425 | Base panel |
| 201 | Central Panel | 428 | Locking tab |
| 202 | End Panels | 429 | Shoulders |
| 203 | Side Panels | 500 | Blank |
| 204 | Flaps | J | Central Panel |
| 205 | Tabs | 502 | End Panels |
| 206 | Roll-Over Panels | 503 | Side Panels |
| 207 | Wing wall contact edge | 504 | Pockets |
| L | Length of container | 506 | Roll-Over Panels |
| W | Width of container | 507 | Wing wall contact edge |
| D | Depth of container | | |

What is claimed is:

1. A container formed from a blank of foldable material, comprising:

a base and four upstanding walls extending therefrom and together defining an open-ended container with an internal space for storing contents therein, the four upstanding walls including a pair of opposing end walls and a pair of opposing side walls, at least one of the end walls configured to move and interlock with the pair of side walls such that the container is transitionable between a contracted configuration and an expanded configuration;

at least one end wall including a pair of wing walls extending from lateral sides thereof, each of the wing walls providing a tab folded outwardly away from the internal space to form an abutment fold and define a pair of pockets between each wing wall and each tab;

each of the side walls providing a cooperating tab folded inwardly toward the internal space to define a lateral edge; and a biasing means to frictionally limit movement of the at least one end wall between the contracted configuration and the expanded configuration, wherein the cooperating tabs of the side walls are slidably received in the respective pockets of each wing wall, such that the at least one end wall is free to move away from the side walls until the lateral edges of the cooperating tabs contact the respective abutment folds thereby limiting further movement of the end wall.

2. The container of claim 1 wherein each wing wall is triangular in shape.

3. The container of claim 1, wherein each tab and each cooperating tab is triangular.

4. The container of claim 1, wherein the abutment fold extends diagonally outwards from the base.

5. The container of claim 1, wherein each tab and each cooperating tab extends laterally along a full length of the respective wing wall or side wall to which it is attached.

6. The container of claim 1, wherein the biasing means comprises at least one lining panel extending from each of the side walls, the lining panel disposed within the internal space to thereby capture the pockets of the wing walls and the cooperating tabs therein, and press them against each respective side wall.

7. The container of claim 1, wherein in the expanded configuration the end walls are prevented from disengaging with the side walls by the lateral edges of the cooperating tabs contacting the respective abutment folds and restricting further movement.

8. The container of claim 1, wherein each of the end walls is configured to move and interlock with each of the of side walls such that the container is transitionable between the contracted configuration and an expanded configuration.

9. The container of claim 1, wherein the container is held in an assembled form by the interlocking end walls and side walls without the need for adhesive.

10. The container of claim 1, wherein in the contracted configuration the wing walls are hidden by the opposing sidewalls and wherein in the expanded configuration the wing walls provide an extension to each side wall resulting in expansion of the internal space of the container.

11. A packaging unit comprising an upper component and a lower component, the upper component serving as a removeable cover for the lower component, wherein at least one of the upper and lower components is a container according to claim 1.

12. The packaging unit of claim 11, comprising a band that extends around the upper component and the lower component to secure the upper and lower components together.

13. The container of claim 11, comprising a closer removably engageable to the container to prevent access to the internal space thereof.

14. A blank of foldable material for forming an open-ended container when assembled, the container including a base and four upstanding walls extending therefrom that together define an internal space for storing contents therein, the blank comprising:

a central panel that provides the base of the container when assembled;

a pair of end panels separated from the central panel by respective first fold lines, the pair of end panels providing end walls of the container when assembled, each of the end panels comprising a pair of lateral flaps separated from a central part thereof by respective third fold lines, the lateral flaps corresponding to wing walls of the container when assembled, wherein each of the lateral flaps comprises a flap segment separated therefrom by respective fourth fold lines, the fourth fold lines extending from the central panel at an angle between the third fold line and an outermost edge of the respective flap segment;

a pair of side panels separated from the central panel by respective second fold lines, the pair of side panels providing side walls of the container when assembled, wherein each of the side panels comprises a pair of lateral tabs separated from a central part thereof by respective fifth fold lines, the fifth fold lines extending perpendicularly to the second fold lines, the lateral tabs being held between the flap segments of the respective lateral flaps when the container is assembled; and a biasing means to frictionally limit movement of at least one of the end walls of the container, when assembled, between a contracted configuration and an expanded configuration, wherein at least one of the end panels and the side panels are configured to movably interlock with one another when the container is assembled, to thereby enable the assembled container to transition between the contracted configuration and the expanded configuration.

15. The blank of claim 14, wherein the wing walls of the container extend substantially perpendicular to the end walls when assembled, the wing walls being hidden behind the side walls when the container is in the contracted configuration and providing an extension of the side walls when the container is in the expanded configuration.

16. The blank of claim 14, wherein the biasing means further comprises a fold-over panel separated from a first of the side panels by a sixth fold line that provides an inner lining of the container when assembled.

17. The blank of claim 16, wherein, when assembled, the fold-over panel or panels extend inwardly over the lateral flaps of the end panels such that the lateral flaps are held captive between the fold-over panel and the respective side panels to bias the lateral flaps against the respective side panels.

18. A method of assembling a container using a blank in accordance with claim 14, comprising the steps of:

folding the end panels inwardly relative to the base about the first fold lines;

folding the side panels inwardly relative to the base about the second fold lines; and interlocking at least one of the end panels with the side panels to thereby define the upstanding walls of the container and the internal space therebetween.

19. The method of claim 18, further comprising the step of:

folding the lateral flaps inwardly relative to the end panel from which the flaps extend about the third fold lines to thereby define the wing walls of the container;

folding each of the lateral flaps outwardly about the fourth fold line forming respective pairs of flap segments arranged back-to-back such that each wing wall is thus formed from a pair of flap segments;

folding the tabs inwardly relative to the side panel from which the tabs extend about the fifth fold lines; and capturing each tab between a respective neighbouring pair of flap segments.

* * * * *